US006790819B2

(12) United States Patent
Trinh et al.

(10) Patent No.: US 6,790,819 B2
(45) Date of Patent: Sep. 14, 2004

(54) FABRIC COLOR CARE METHOD

(75) Inventors: Toan Trinh, Maineville, OH (US); Mary Vijayarani Barnabas, West Chester, OH (US); Eugene Paul Gosselink, Cincinnati, OH (US); John William Smith, Milford, OH (US); Helen Bernardo Tordil, Fairfield, OH (US); Robb Richard Gardner, Cleves, OH (US); Timothy Woodrow Coffindaffer, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 54 days.

(21) Appl. No.: 09/999,270

(22) Filed: Nov. 15, 2001

(65) Prior Publication Data

US 2002/0112293 A1 Aug. 22, 2002

Related U.S. Application Data

(60) Provisional application No. 60/249,242, filed on Nov. 16, 2000.

(51) Int. Cl.[7] ..... C11D 9/36; C11D 3/22

(52) U.S. Cl. ..... 510/287; 510/276; 510/279; 510/406; 510/466; 510/470; 510/499; 510/500; 510/504

(58) Field of Search ..... 510/276, 279, 510/287, 406, 466, 470, 499, 500, 504

(56) References Cited

U.S. PATENT DOCUMENTS

| | | | | | |
|---|---|---|---|---|---|
| 5,443,750 | A | * | 8/1995 | Convents et al. | 252/174.12 |
| 5,686,376 | A | * | 11/1997 | Rusche et al. | 502/329 |
| 5,977,055 | A | * | 11/1999 | Trinh et al. | 510/515 |
| 6,040,288 | A | | 3/2000 | Popoff et al. | |
| 6,077,818 | A | * | 6/2000 | Baeck et al. | 510/374 |

FOREIGN PATENT DOCUMENTS

| | | | |
|---|---|---|---|
| EP | 0 841 391 | A1 | 5/1998 |
| WO | WO 98/20098 | A1 | 5/1998 |
| WO | WO 98/39401 | A1 | 9/1998 |
| WO | WO 99/41347 | A1 | 8/1999 |

* cited by examiner

*Primary Examiner*—Charles Boyer
(74) *Attorney, Agent, or Firm*—Jason J. Camp; David V. Upite

(57) ABSTRACT

The present invention relates to fabric care methods for restoring and/or rejuvenating color of worn, faded fabric, by applying to said fabric a fabric color care composition which comprises: water soluble and/or water dispersible polymers; surfactant capable of forming a bilayer structure; and mixtures thereof. Optionally, the composition can contain other ingredients to provide additionally fabric care benefits, and/or to improve performance and formulability. The composition is preferably applied as small particle size droplets, especially from spray container that preferably are in association with a set of instructions for use.

24 Claims, No Drawings

FABRIC COLOR CARE METHOD

This appln claims benefit of 60/249,242 Nov. 16, 2000.

TECHNICAL FIELD

The present invention relates to fabric care compositions, articles of manufacture and/or methods of use for treating fabrics to improve fabric appearance, especially with regards to color of fabrics, especially those that have been worn and having a faded appearance.

BACKGROUND OF THE INVENTION

There is a continuous need for improved compositions, products, and methods that provide useful benefits to fabrics, especially clothing, such as maintaining and/or improving a good appearance, especially fabric color, especially for fabric that have been worn, through a simple and convenient application of a product.

Consumers commonly judge the desirability and wearability of a garment by many appearance criteria, such as, absence of color fading, absence of wrinkles, absence of soiling and staining, absence of damage such as pilling, and the like. It is preferable that these benefits are provided via simple and convenient consumer compositions, methods and products, that can be applied in the consumer's home. These consumer compositions and products are preferably safe, and do not involve complicated and/or unsafe treatments and/or applications. Desirably they comprise treatments that are familiar to the consumers, such as spraying, soaking, adding to the wash cycle, adding to the rinse cycle, and/or adding to the drying cycle.

Many published fabric care compositions methods try to provide fabric maintenance benefits, e.g., keep fabric from, e.g., fading, wear, pilling, soiling, staining, shrinkage, and the like. However, fabric articles, such as clothing, that are worn and used will get damaged via, e.g., mechanical abrasion in use and in the laundry washing processes. The resulting worn, damaged fabric can have loosened fabric weave and pilling. Worn, damaged color fabric especially has a undesirable faded appearance. A common method that the consumer can practice to improve and/or restore the color of such worn, faded fabric is the use of fabric dyes. However, dyeing processes done at home tend to result in color bleeding in the subsequent washes that can discolor other fabrics in the same wash. Furthermore, when the fabric color is not uniform, such as when the fabric has a design with different colors and/or different tones of the same color, the use of fabric dyes is not desirable.

The present invention comprises compositions, articles of manufacture, and/or method of use that can be used to improve color fidelity, i.e., recover, restore, rejuvenate color of worn, damaged clothing upon a single application. The color benefit provided by the compositions, articles and/or methods of the present invention will endure after the treated fabric is washed at least one time, and preferably at least after the fabric is washed two times.

The present invention optionally can provide other fabric care benefits, such as abrasion resistance, wrinkle removal, pill prevention, anti-shrinkage, and fabric shape retention.

SUMMARY OF THE INVENTION

The present invention relates to fabric color care compositions, preferably aqueous and/or alcoholic fabric color care compositions, and fabric care methods for treating fabrics by direct application of said fabric color care composition to said fabrics. The present invention further relates to articles of manufacture that facilitate the use of said fabric color care compositions to restore and/or rejuvenate the color of worn, faded color fabrics, such that the color benefit can be detected after the treated fabric is washed at least one time, and more preferably at least two times. The present invention also relates to the use of selected enduring fabric color care actives and composition comprising said enduring fabric color care actives to restore and/or rejuvenate the color of worn, faded color fabrics such that the color benefit lasts at least after the treated fabric is washed and dried one time, preferably at least after the treated fabric is washed and dried two times.

The enduring fabric color care active that can provide a long lasting color restoration and/or rejuvenation benefit to worn, faded fabrics is characterized by its ability to reduce the two following properties of said fabric, namely, its reflectance and its pill number.

A preferred enduring fabric color care composition comprises an effective amount of fabric color care active preferably being selected from the group consisting of:

(A) water soluble and/or water dispersible cationic polymer; said polymer being selected from the group consisting of natural polymers, synthetic polymers, substituted materials thereof, derivatised materials thereof, and mixtures thereof;

(B) water dispersible reactive silicone, including silicones comprising amino functional groups; and (C) mixtures thereof;

said composition additionally being essentially free of any material that would cause the treated fabric to feel unduly sticky, or "tacky" to the touch under usage conditions, and wherein said fabric color care active is preferably colorless at the level used, to minimize the change of hue and to improve the color fidelity.

Said composition is applied to fabric in a positive step, e.g., spraying, dipping, and/or soaking process, followed by a drying step to maximize the application and retention of the active to the surface of the fibers. Preferably the treatment is by spray and/or roller so that the active is primarily applied to the visible surface of the fabric. The present invention also preferably relates to the fabric care compositions incorporated into a spray dispenser, to create an article of manufacture that can facilitate treatment of fabric articles and/or surfaces with said compositions containing fabric color care active and other optional ingredients at a level that is effective.

For some compositions, where inhalation is a concern, it is more suitable to treat fabric by dipping in such compositions.

Also, concentrated aqueous, alcoholic, or solid, preferably powder, fabric color care compositions can be used to prepare such compositions for treating worn, faded and/or damaged fabric.

The present invention also relates to a method for restoring and/or rejuvenating color of a worn, faded color fabric, wherein the color benefit can be detected after the treated fabric is washed one time, and wherein said method comprises applying an effective amount of a fabric color care active to said fabric, wherein said fabric color care active is selected from the group consisting of:

(A) water soluble and/or water dispersible cationic polymer, substituted materials thereof, derivatised materials thereof, and mixtures thereof;

(B) water dispersible reactive silicone, including amino functional silicone; and mixtures thereof; and (C) mixtures thereof;

and wherein the color restoration and/or rejuvenation is characterized by the ability of said active to change the properties of a worn, faded black cotton (chino) twill test fabric, said changes in properties comprising:

(a) a percentage reflectance reduction ΔR of at least about 3%; preferably at least about 5%, more preferably at least about 8%, and even more preferably at least about 10%; and (b) a percentage pill number reduction ΔP of at least about 10%, preferably at least about 20%, more preferably at least about 40%, and even more preferably at least about 80%.

It is especially preferred that an article of the present invention, or any container containing said composition or a concentrate used to prepare a composition of the present invention have a set of instructions associated therewith to inform the consumer that the composition can provide the color restoration benefit to worn, damaged and faded color fabric. Without knowledge of this unobvious benefit, a consumer would be highly unlikely to treat the visible surface of the fabric, especially older fabrics, and might even discard the fabric when it could be substantially restored to near-new condition.

DETAILED DESCRIPTION OF THE INVENTION

The present invention relates to fabric color care compositions, preferably aqueous fabric color care compositions, and fabric care methods for treating fabrics by direct application of said fabric color care compositions to said fabrics. The present invention further relates to articles of manufacture that facilitate the use of said fabric color care compositions to restore and/or rejuvenate the color of worn, faded color fabrics, such that the color benefit may be detected after the treated fabric is washed at least one time, and preferably at least two times. The present invention also relates to the use of selected enduring fabric color care actives and compositions comprising said enduring fabric color care actives to restore and/or rejuvenate the color of worn, faded color fabrics such that the color benefit lasts at least after the treated fabric is washed one time, preferably at least after the treated fabric is washed two times.

The color restoration and/or rejuvenation benefit to the worn, faded fabric is characterized by the ability of the fabric color care active to change the two following properties of worn, faded black cotton (chino) twill test fabric (as defined hereinbelow), said changes in properties comprising:

(A) a percentage reflectance reduction ΔR of at least about 3%, preferably at least about 5%, more preferably at least about 8%, and even more preferably at least about 10%; and (B) a percentage pill number reduction ΔP of at least about 10%, preferably at least about 20%, more preferably at least about 40%, and even more preferably at least about 80%;

with ΔR and ΔP being measured on treated fabric that is washed and dried at least one time, preferably at least two times, as compared to the untreated worn, faded black cotton fabric that are washed and dried similarly.

The preferred fabric color care composition of the present invention comprises:

(A) an effective amount of fabric color care active for restoring and/or rejuvenating the color of worn, faded color fabric, said fabric color care active is preferably selected from the group consisting of water soluble and/or water dispersible cationic polymer, substituted materials thereof, derivatised materials thereof, and mixtures thereof; water dispersible reactive silicone, including silicones comprising amino functional groups; and mixtures thereof;

(B) optionally, an effective amount to provide olfactory effects of perfume;

(C) optionally, to reduce surface tension, and/or to improve performance and formulatability, an effective amount of surfactant;

(D) optionally, an effective amount to absorb malodor, of odor control agent;

(E) optionally, an effective amount, to kill, or reduce the growth of microbes, of antimicrobial active;

(F) optionally, an effective amount to provide improved antimicrobial action of aminocarboxylate chelator;

(G) optionally, an effective amount of antimicrobial preservative; and (H) optionally, an aqueous and/or alcoholic carrier;

said composition additionally being essentially free of any material that would cause the treated fabric to feel unduly sticky, or "tacky" to the touch under usage conditions, and wherein said fabric color care active is preferably colorless at the level used, to minimize the change of hue and to improve the color fidelity.

The present invention also relates to methods and articles of manufactures for treating fabrics using compositions comprising preferred fabric-substantive and/or fabric reactive fabric color care actives to provide a more durable color restoration and/or color rejuvenation benefit that lasts at least after one washing cycle, preferably at least after two or more washing cycles.

The present invention also relates to branded articles of manufacture comprising the fabric color care composition of the present invention whose value to the consumer has been improved by marketing it in association with the information that durable color restoration and/or rejuvenation benefit to a fabric can be obtained and/or achieved by applying at least an effective amount of said fabric care composition to said fabric. By "branded" it is meant that the article can be identified as one that has been associated with the indicated benefit, thus, including trademarks, tradenames, and any other identifying characteristic such as trade dress, color, odor, sound, etc. that the consumer can use to associate the particular article with a specific benefit that has been taught. This enables the consumer to know that the benefit can be achieved, even when the product is separated from the original information, e.g., when the product has had part of the instructions destroyed, or when the article is marketed without the information about the specific benefit.

The present invention relates to the application of an effective amount of an enduring fabric color care active and/or fabric color care composition to fabric to modify the following fabric properties, namely, a reduction of reflectance, and a reduction of the microfibril number to reduce the loss of fabric color and/or to recover fabric color. It has not previously been recognized that the use of the above compositions can provide good color restoration and/or recovery.

The present invention can optionally provide other fabric care benefits, such as, fabric wear reduction, fabric wear resistance, fabric pilling reduction, fabric color maintenance, fabric soiling reduction, fabric soil release, wrinkle resistance, wrinkle reduction, anti-shrinkage, fabric shape retention, and mixtures thereof.

Methods for Determining the Observed Color Restoration Benefit

The utility of a fabric color care active can be determined by the following simple screening test procedures. The desired fabric properties are determined using worn black chino (cotton) twill test fabric that is available from TESTFABRICS, Inc., West Pittston, Pa. Worn black cotton twill test fabric is obtained by treating new fabric through eight treatment cycles, each washing/drying treatment cycle comprises of one washing/rinsing cycle with the AATCC powder detergent, all cycles using about 90° F. water in a Kenmore automatic clothes washer Model 110, followed by a drying cycle in a Kenmore automatic electric tumble dryer Model 110. The resulting test fabric is visibly worn and faded. Some worn fabric samples are retained for use as control worn fabrics. Other worn fabric samples are treated using the method of the present invention. The treated and untreated fabric samples are washed and dried one more time in the washer with hand wash setting, with detergent and with cold water. After drying, the rewashed control and therewashed treated fabrics are examined visually and their properties are determined by the following two test procedures.

Reflectance

The reduction of reflectance of a fabric is determined using the optical measurement from the LabScan® XE instrument from Hunter Associates Laboratory, Inc, Reston, Va. The LabScan® XE is a full-scanning spectrophotometer with a wavelength range from 400 to 700 nanometer. The sample is illuminated by a xenon flash lamp and reflected light is collected by a 15-station fiber optic ring. For reflectance measurements, the diameter of opening in port is 50 mm. The illumination angle is 0° (normal) to the specimen. The viewing angle is 45° from normal via fiber optic ring.

The reflectance of the whole range of wavelength from about 420 nm to about 620 nm is measured for the black cotton twill test fabrics. For each wavelength at increments of about 10 nm, the reflectance of the treated fabric (Rt) and that of the worn, untreated fabric (Ru) are measured. The percentage reduction of the reflectance for each wavelength is $$\Delta R=100\times\{(\Sigma Ru-\Sigma Rt)/\Sigma Ru\}\%$$

For a noticeable improvement and/or restoration of fabric color, ΔR should be a positive number and having a value of at least about 3%, preferably at least about 5%, more preferably at least about 8%, and even more preferably at least about 10%.

Microfibril Number

An image analysis system is used to estimate the number of pills on the untreated and treated black cotton twill fabrics that are used to define the observed color restoration benefit. The general setup and procedure are described in "Efforts to Control Pilling in Wool/Cotton Fabrics", Jeanette M. Cardamone, *Textile Chemist and Colorist,* 31, 27–31 (1999), incorporated herein by reference. The image analysis system utilizes a light booth with a circular fluorescent light bulb. The bulb is just above the plane of the fabric. The fabric is put into the light booth via a drawer. To remove any wrinkle the fabric is held own at the edges by a Plexiglas clamp (imagine a Plexiglas book with a hole in the cover here the fabric shows through). The pills rise above the fabric and reflect light to the monochrome camera mounted above. The camera and video frame grabber are adjusted so that the pills show up as bright features against the plane of the fabric that shows up as a dark background. The image is thresholded, and the bright blobs (pills) are counted and sized. The image analysis is done using a custom macro written in the OPTIMAS image analysis software package, available at the Meyer Instruments, Inc., Houston, Tex. The "pill number" (Pt) for the treated black cotton twill fabric and that of the worn, untreated fabric (Pu) are determined. The percentage reduction of the pill number ΔP is $$\Delta P=100\times(Pu-Pt)/Pu\%$$

It is found that for an appreciable color restoration benefit to be provided by a fabric color care composition, ΔP should be a positive number and have a value of at least about 10%, preferably at least by about 20%, more preferably at least about 40%, and even more preferably at least about 80%. A preferred enduring fabric color care active of the present invention comprises of water dispersible, preferably water soluble cationic polymers which contain quaternized nitrogen groups and/or nitrogen groups having strong cationic charges which are formed in situ under the conditions of usage. They can be natural, or synthetic polymers, substituted polymer materials thereof, derivatised polymer materials thereof, and mixtures thereof. A particularly preferred class of polymer comprises water dispersible reactive silicones, including silicones comprising amino functional groups.

Cationic Derivatives of Natural Polymers

Preferred enduring fabric color care actives of the present invention include water soluble and/or water dispersible cationic derivatives of natural polymers which are derived from natural sources, preferably polysaccharides, oligosaccharides, proteins; substituted versions of said polymers; and mixtures thereof. The preferred polymer is preferably colorless under usage conditions, to minimize the change of hue and to improve the color fidelity.

Preferred active of this class is selected from the group consisting of cationic derivatives of polysaccharides; proteins; glycoproteins; glycolipids; substituted versions of said polymers; and mixtures thereof.

Synthetic Polymers

Another preferred enduring fabric color care active of the present invention include water soluble and/or water dispersible cationic synthetic polymers. The preferred polymer is preferably colorless under usage conditions, to minimize the change of hue and to improve the color fidelity. Cationic enduring fabric color care synthetic polymer includes: homopolymer and copolymer containing hydrophilic monomers and/or hydrophobic monomers.

Specially preferred enduring fabric color care synthetic polymer includes: water dispersible silicones comprising amino functional groups, including reactive, curable silicones comprising amino functional groups, and their derivatives. A class of silicone derivatives that is particularly preferred in the present invention is cationic silicones containing polyalkylene oxy groups, including reactive, curable silicones comprising cationic aminofunctional groups and polyalkyleneoxy groups. Also preferred are reactive, curable silicones comprising polyalkyleneoxy groups, but not cationic amino functional groups. The polyalkyleneoxy groups hereinabove comprise at least some ethyleneoxy units.

A preferred fabric color care composition for treating worn and/or faded colored fabrics comprises an effective amount of said fabric color care active, and optionally, at least one adjunct ingredient selected from the group consisting of perfume, odor control agent, antimicrobial active and/or preservative, surfactant, optical brightener, antioxidant, chelating agent including aminocarboxylate chelating agent, antistatic agent, dye transfer inhibiting agent, fabric softening active, and/or static control agent.

Enzymes are not preferred in the compositions of the present invention, especially in the spray compositions, because aerosolized particles containing enzymes often constitute a health hazard. Cationic dye fixing agents are also not preferred.

The composition is typically applied to fabric via a positive step, e.g., spraying, dipping, soaking and/or direct padding process, e.g., impregnating the fabric using rollers, brushes, foam, printing, to treat substantially all of the visible surface followed by a drying step, including the process comprising a step of treating or spraying the fabric with the fabric care composition either outside or inside an automatic clothes dryer followed by, or concurrently with, the drying step in said clothes dryer. The application can be done industrially by large scale processes on textiles and/or finished garments and clothing, or, preferably, in the consumer's home through the use of commercial consumer products comprising enduring fabric color care actives.

The fabric color care spray composition contains enduring fabric color care active at a level of from about 0.01% to about 20%, typically from about 0.05% to about 10%, preferably from about 0.1% to about 5%, more preferably from about 0.2% to about 3%, even more preferably from about 0.3% to about 2%, by weight of the usage composition.

The present invention also relates to concentrated liquid or solid fabric color care compositions, which are diluted to form compositions with the usage concentrations, as given hereinabove, for use in the "usage conditions". Concentrated compositions comprise a higher level of enduring fabric color care active, typically from about 1% to about 99%, preferably from about 2% to about 65%, more preferably from about 3% to about 25%, by weight of the concentrated fabric color care composition. Concentrated compositions are used in order to provide a less expensive product per use. When a concentrated product is used, i.e., when the fabric color care active is from about 1% to about 99%, by weight of the concentrated composition, it is preferable to dilute the composition before treating fabric. Preferably, the concentrated fabric care is diluted with about 50% to about 10,000%, more preferably from about 50% to about 8,000%, and even more preferably from about 50% to about 5,000%, by weight of the composition, of water.

The present invention also relates to concentrated liquid or solid fabric color care compositions wherein the enduring color care actives are reactive and/or hydrolyzable, and preferably need to be isolated from any water that is present in the compositions, to improve the storage stability of the product. Concentrated compositions comprise a higher level of reactive enduring fabric color care active, typically from about 1% to about 99%, preferably from about 2% to about 65%, more preferably from about 3% to about 25%, by weight of the concentrated fabric color care composition. In use, the product is diluted to form compositions with the usage concentrations, as given hereinabove, for immediate use in the "usage conditions". Alternatively, a relatively concentrated composition can be applied directly on wet fabrics so that the enduring color care actives can be diluted in situ on the wet fabrics, e.g., fabrics that have washed without drying before applying a composition of the present invention. When applied directly to wet fabric, the fabrics color care compositions of the present invention contain said fabric color care active at a level from about 0.01% to about 25%, preferably from about 0.1% to about 10%, more preferably from about 0.2% to about 5%, and even more preferably from about 0.3% to about 3% by weight of the composition.

The present invention preferably comprises articles of manufacture that include such fabric color care compositions. Thus the present invention relates to the compositions incorporated into a spray dispenser to create an article of manufacture that can facilitate treatment of fabric surfaces with said fabric care compositions containing a fabric color care active and other optional ingredients at a level that is effective when dried on the surfaces. The spray dispenser comprises manually activated and non-manual powered (operated) spray means and a container containing the fabric color care composition. For a non-manually operated sprayer, preferably battery powered for safety reasons in the home, the container is preferably the one sold in the store containing the fabric color care composition that is applied to the fabric, adapted to be used with the particular sprayer. The invention also comprises containers that are adapted for use with spray dispensers.

The present invention also relates to an article of manufacture comprising fabric care compositions at usage concentrations to facilitate treatment of fabric surfaces with said fabric care compositions containing a fabric color care active and other optional ingredients at a level that is effective, said composition is applied to fabric in a positive step, e.g., dipping, soaking, padding process, or by a roller, followed by a drying step to maximize the application and retention of the active to the surface of the fibers. More preferably, the article of manufacture comprises concentrated fabric care compositions to be diluted to usage concentrations in use.

Preferably, the articles of manufacture are in association with a set of instructions that direct the consumer how to use the composition to treat fabrics correctly, to obtain the desirable fabric care results, viz, color renewal, and preferably, other additional fabric care benefits, such as wrinkle removal, wrinkle resistance, fiber strengthening/anti-wear, pill prevention, anti-shrinkage, soiling prevention and/or reduction, and/or fabric shape retention, including, e.g., the manner and/or amount of composition to used, and the preferred ways of checking for completeness of application, stretching and/or smoothing of the fabrics. Ironing and/or smoothing can help distribute the active over the surface and partially compensate for incomplete distribution. As used herein, the phrase "in association with" means the instructions that are either directly printed on the container itself or presented in a different manner including, but not limited to, a brochure, print advertisement, electronic advertisement, and/or verbal communication, so as to communicate the set of instructions to a consumer of the article of manufacture. It is important that the instructions be simple and clear. The use of pictures and/or icons within the instructions may be desirable.

I. Composition

Enduring Fabric Color Care Active

The fabric color care spray composition contains an enduring fabric color care active at a level of from about 0.01% to about 20%, typically from about 0.05% to about 10%, preferably from about 0.1% to about 5%, more preferably from about 0.2% to about 3%, even more preferably from about 0.3% to about 2%, by weight of the usage composition. The present invention also relates to concentrated liquid or solid fabric color care compositions, which are diluted to form compositions with usage concentrations, as given hereinabove, for use under "usage conditions". Concentrated compositions comprise a higher level of enduring fabric color care active, typically from about 1% to about 99%, preferably from about 2% to about 65%, more preferably from about 3% to about 25%, by weight of the concentrated fabric color care composition. Concentrated compositions are used in order to provide a less expensive product per use. When a concentrated product is used, i.e., when the enduring fabric color care active is from about 1% to about 99%, by weight of the concentrated composition, it is preferable to dilute the composition before treating fabric. Preferably, the concentrated fabric care is diluted with about 50% to about 10,000%, more preferably from about 50% to about 8,000%, and even more preferably from about 50% to about 5,000%, by weight of the composition, of water.

Preferred enduring color care active includes cationic and/or reactive polymers to provide color restoration to worn, faded fabric. Said polymers comprise cationic functional groups, and/or reactive groups that can further condense to form higher molecular weight polymers. Useful cationic polymers include natural polymers, derivatives thereof, synthetic polymers, and mixtures thereof. These polymers are preferably colorless, to minimize the change of hue and to improve the color fidelity.

Water Soluble and Water Dispersible Derivatives of Natural Polymers

An enduring fabric color care active useful in the present invention comprises water soluble and/or water dispersible cationic polymers derived from natural sources, preferably selected from the group consisting of polysaccharides; proteins; glycoproteins; glycolipids; substituted versions thereof; derivatised versions thereof; and mixtures thereof. The preferred polymer is colorless at the effective concentrations, to minimize the change of hue and to improve the color fidelity.

Water Soluble/Dispersible Polysaccharides

Preferably, said polysaccharides have a molecular weight of from about 1,000 to about 2,000,000, more preferably from about 5,000 to about 1,000,000, and even more preferably from about 10,000 to about 300,000. Nonlimiting examples of water soluble/dispersible polysaccharides to form cationic derivatives useful in the present invention includes the following:

(i) Heteropolysaccharides derived from the bark, seeds, roots and leaves of plants, which are divided into two distinct groups, namely, acidic polysaccharides described as gums, mucilages and pectins, and the neutral polysaccharides known as hemicelluloses, (ii) Algal polysaccharides including food-reserve polysaccharides (e.g., laminaran), structural polysaccharides (e.g., D-xylans, D-mannans), sulphated polysaccharides that are isolated from algae (e.g., carrageenan, agar), other algal mucilages which have similar properties and usually contain L-rhamnose, D-xylose, D-glucuronic acid, D- and L-galactose and D-mannose, (iii) Microbial polysaccharides, such as teichoic acids, cell wall peptidoglycans (mureins), extracellular polysaccharides, gram-positive bacterial capsular polysaccharides and gram-negative bacterial capsular polysaccharides.

(iv) Lipopolysaecharides, (v) Fungal polysaccharides, and (vi) Animal polysaccharides (e.g., glycogen, chitosan).

A preferred polysaccharide is hemicelluloses selected from the group consisting of L-arabino-D-galactan; D-gluco-D-mannan, D-galacto-D-gluco-D-mannan, partly acetylated (4-O-methyl-D-glucurono)-D-xylan, L-arabino-(4-O-methyl-D-glucurono)-D-xylan; substituted versions thereof; derivatised versions thereof; and mixtures thereof; and more preferably, arabinogalactan. Arabinogalactans are long, densely branched high-molecular weight polysaccharides. Arabinogalactan that is useful in the composition of the present invention has a molecular weight range of from about 5,000 to about 500,000, preferably from about 6,000 to about 250,000, more preferably from about 10,000 to about 150,000. These polysaccharides are highly branched, consisting of a galactan backbone with side-chains of galactose and arabinose units. Most commercial arabinogalactan is produced from western larch, through a counter-current extraction process. Larch arabinogalactan is water soluble and is composed of arabinose and galactose units in about a 1:6 ratio, with a trace of uronic acid. The molecular weights of the preferred fractions of larch arabinogalactan include one fraction in the range of from about 14,000 to about 22,000, mainly from about 16,000 to about 21,000, and the other in the range of from about 60,000 to about 500,000, mainly from about 80,000 to about 120,000. The fraction that has the average molecular weight of from about 16,000 to about 20,000 is highly preferred for use in direct applications to fabric, such as in spray-on products.

Other cationic polysaccharides such as chitosan are also useful in the present invention. Chitosan is poly (D-glucosamine) and is derived from chitin, a linear polysaccharide consisting of N-acetyl-D-glucosamine. Chitin is widely distributed in nature, e.g., in the shells of crustaceans and insects, and in the cell wall of bacteria. Chitosan is prepared by the deacetylation of chitin. Chemically, chitosan is very similar to cellulose, differing only in the fact that chitosan has an amino group instead of hydroxyl group at C-2. In spite of the similarity in structure with cellulose, the chemical and physical properties of chitosan are significantly different from those of cellulose. Preferred chitosan materials for use in the present invention are ethoxylated chitosans wherein polyethylene glycol moieties are grafted to chitosan to improve its solubility.

Water Soluble/Dispersible Proteins

Nonlimiting examples of water soluble/dispersible proteins useful in the present invention includes: globular proteins, such as albumins, globulins, protamines, histones, prolamines and glutelins; low levels of fibrous proteins, such as elastin, fibroin and sericin; and conjugated proteins with one or more non-protein moieties such as carbohydrates, lipids, and phosphate residues. The proteins useful herein preferably do not include enzymes, specially in the spray compositions, because aerosolized particles containing enzymes often constitute a health hazard.

Nonlimiting examples of such enduring fabric color care actives include cationic arabinogalactan, cationic functional celluloses, and polyethoxylated chitosan. An example of cationic arabinogalactans is LaraCare® C300, a hydroxypropyl trimethyl ammonium chloride derivative of arabinogalactan, having $—CH_2—CH(OH)—CH_2—N^+(CH_3)_3Cl^-$ pendant groups, available from Larex, Inc., White Bear Lake, Minn. Examples of water soluble quaternary cellulose derivatives are Celquat® polymers, available from National Starch & Chemical Company, Bridgewater, N.J. Examples of Celquat polymers include Celquat H-100 and Celquat L-200 which are of Polyquaternium-4 type, that is polymeric quaternary ammonium salt of hydroxyethylcellulose and diallyldimethyl ammonium chloride, and Celquat SC230M and Celquat SC240C which are of Polyquaternium-10 type, that is polymeric quaternary ammonium salt of hydroxyethylcellulose reacted with a trimethyl ammonium substituted epoxide. Celquat H-100 has a percentage quaternized nitrogen of about 1.0 and a molecular weight of about 1,400,000; Celquat L-200 has a percentage quaternized nitrogen of about 2.0 and a molecular weight of about 300,000; Celquat SC230M has a percentage quaternized nitrogen of about 1.9 and a molecular weight of about 1,700,000; and Celquat SC240C has a percentage quaternized nitrogen of about 1.8 and a molecular weight of about, 1,100,000. An example of silk proteins is Aquapro® QW, available from Mid West Grain Products. Aqua Pro II QW is a quaternized hydrolyzed wheat protein (stearyldimonium hydroxypropyl hydrolyzed wheat protein) provided in its liquid form.

Water Soluble and Water Dispersible Cationic Synthetic Polymers

Another preferred enduring fabric color care active of the present invention includes water soluble and/or water dispersible cationic synthetic polymers. The preferred polymer is colorless at the effective concentrations, to minimize the change of hue and to improve the color fidelity. Cationic enduring fabric color care synthetic polymers includes homopolymers and copolymers comprising hydrophilic monomers and/or hydrophobic monomers. Nonlimiting examples of enduring fabric color care synthetic polymeric actives include aminofunctional silicones, reactive, curable silicones, ethoxylated polyamines, and mixtures thereof. A class of silicone derivatives that is particularly preferred in the present invention is cationic silicones containing polyalkyleneoxy groups, including reactive, curable silicones comprising cationic aminofunctional groups and polyalkyleneoxy groups. Also useful are reactive, curable silicones comprising polyalkyleneoxy groups, but not cationic amino functional groups. The polyalkyleneoxy groups hereinabove comprise at least some ethyleneoxy units. Preferably aminofunctional silicones containing ethoxylated moieties. For reactive, curable silicones comprising polyalkyleneoxy groups, the polyalkyleneoxy groups are preferably capped with $C_{1-6}$alkyl groups and/or other nonreactive groups.

Silicones

Preferred enduring fabric color care active comprises cationic aminofunctional silicones; reactive, curable silicones and derivatives thereof; and mixtures thereof.

Cationic Aminofunctional Silicones. Cationic aminofunctional silicones comprise cationic —X—E groups, with each X being a hydrocarbon or oxygenated hydrocarbon linking group, preferably being selected from the group consisting of $—CH_2CH_2CH_2—$, $—CH_2CH_2—$, $—CH_2CH(OH)CH_2OCH_2CH_2CH_2—$, and $—CH_2$-phenylene-$CH_2CH_2—$, and mixtures thereof; and each E being a cationic nitrogen functional group, preferably being selected from the group consisting of amino group and quaternary ammonium derivatives thereof; cyclic amino group and quaternary ammonium derivatives thereof; imidazole group and imidazolium derivatives thereof; imidazoline group and imidazolinium derivatives thereof; and mixtures thereof. Each cationic functional XE group can be a pendant group, a terminal group situated at the ends of the silicone polymer backbone, an internal group incorporated as part of the silicone polymer backbone chain, and mixtures thereof. Aminofunctional silicones, optionally, but preferably, comprise one or more polyalkyleneoxy groups comprising at least some ethyleneoxy units, wherein each polyalkyleneoxy group can be a pendant group, a terminal group situated at the ends of the silicone polymer backbone, an internal group incorporated as part of the silicone polymer backbone chain, and mixtures thereof. When polyalkyleneoxy groups are present as terminal and/or pendant groups, each cationic functional XE group can also be situated at the end of said polyalkeneoxy groups.

Suitable cationic aminofunctional silicones of the current invention conform to the following general structure I:

$$(R^1)_aR_{3-a}Si—(—O—SiR_2)_m—(—O—SiRB)_p—(—O—SiRD)_q—[OSiR_2—J—(G)_g—(J)_j—(E)_k—J—SiR_2]_r—O—Si(R^1)_bR_{3-b} \quad (I)$$

wherein:

each R group is the same or different and is preferably an alkyl, aryl, and mixtures thereof, more preferably, each R is methyl, ethyl, propyl, butyl, or phenyl group, most preferably R is methyl;

each cationic B group is an —X—E group with each X being a hydrocarbon or oxygenated hydrocarbon linking group, preferably being selected from the group consisting of $—CH_2CH_2CH_2—$, $—CH_2CH(CH_3)CH_2—$, $—CH_2CH_2—$, $—CH_2CH(OH)CH_2OCH_2CH_2CH_2—$, and $—CH_2$-phenylene-$CH_2CH_2—$, and mixtures thereof; and each E being a cationic nitrogen functional group. preferably being selected from the group consisting of amino group and quaternary ammonium derivatives thereof; cyclic amino group and quaternary ammonium derivatives thereof; imidazole group and imidazolium derivatives thereof; imidazoline group and imidazolinium derivatives thereof; polycationic group, and mixtures thereof;

each optional, but preferred D group is a poly(ethyleneoxy/propyleneoxy) group having the general structure:

$$—Z—O(C_2H_4O)_c(C_3H_6O)_dR^3$$

wherein each Z is a linking group, preferably selected from the group consisting of hydrocarbon or oxygenated hydrocarbon linking group, e.g., $—CH_2CH_2CH_2—$, $—CH_2CH_2—$, $—CH_2CH(OH)CH_2OCH_2CH_2CH_2—$, phenylene-$CH_2CH_2$— and $—CH_2$-phenylene-$CH_2CH_2$—; aminohydrocarbon linking group, e.g., $—CH_2CH_2CH_2—N<$ group; and mixtures thereof; each $R^3$ group is the same or different and being preferably selected from the group consisting of hydrogen, R, cationic nitrogen functional E group, $—CH_2CH(R)OH$, $—CH_2C(R)_2OH$, $—CH_2CH(OH)CH_2OR$, $—CH_2CH(OH)CH_2(OCH_2CH_2)_eOR$, tetrahydropyranyl, —CH(R)OR, C(O)H, and/or —C(O)R group, more preferably $R^3$ group is an R group, with R being more preferably selected from methyl and/or ethyl group; each c is at least about 2, preferably at least about 5, more preferably at least about 11, and even more preferably at least about 21, total c (for all polyalkyleneoxy side groups) has a value of from about 4 to about 2500, preferably from about 6 to about 1000, more preferably from about 11 to about 800, and even more preferably from about 21 to about 500; total d is from 0 to about 1000, preferably from 0 to about 300; more preferably from 0 to about 100, and even more preferably d is 0; preferably total c is equal or larger than total d; total c+d has a value of from about 4 to about 2500, preferably from about 8 to about 800, and more preferably from about 15 to about 500; and each e is from 1 to about 20, preferably 1 or 2;

each optional G is $—O(C_2H_4O)_v(C_3H_6O)_w—$; each J is selected from X and $—CH_2CH(OH)CH_2—$; each optional E is a cationic group defined as hereinabove; each v is from 0 to about 200, preferably from about 5 to about 150, more preferably from about 11 to about 120, and even more preferably from about 21 to about 100; each w is from 0 to about 50 and preferably v is equal or larger than w; each g and k is from 0 to about 10, preferably from 0 to about 6, more preferably from about 1 to about 3, and even more preferably from about 1 to about 2; j is g+k−1, within the segment designated as $(G)_g—(J)_j—(E)_k$, the units can be arranged in any order, providing that no O—O bonds and/or N—N are formed;

each $R^1$ group is the same or different and is preferably selected from the group consisting of R, B, and/or D group;

each a and/or b is an integer from 0 to 3, preferably 2, more preferably 1;

m is from about 5 to about 1600, preferably from about 6 to about 800, more preferably from about 8 to about 400, and even more preferably from about 10 to about 200;

a, and b, p, and the $R^1$ groups of the terminal groups $(R^1)_aR_{3-a}Si—O—$ and $—O—Si(R^1)_bR_{3-b}$ are selected such that the silicone polymer comprises at least one cationic group in the form of an Si—B group; with typically the p to (m+p) ratio ranges from 0 to about 1:2, preferably from about 1:200 to about 1:3, more preferably from about 1:100 to about 1:4, and even more preferably from about 1:50 to about 1:4; and a, and b, q, and the $R^1$ groups of the terminal groups $(R^1)_aR_{3-a}Si—O—$ and $O—Si(R^1)_bR_{3-b}$ are selected such that the silicone polymer optionally comprises at least one poly(ethyleneoxy/propyleneoxy) Si—D group; and preferably at least about two Si—D groups; with typically the q to (m+p+q) ratio ranges from about 1:1000 to about 1:3, preferably from about 1:200 to about 1:4, more preferably from about 1:100 to about 1:4, and even more preferably from about 1:50 to about 1:5;

r is from 0 to about 100, preferably r is 0; when r is not 0 it is preferably from 1 to about 20, more preferably from 1 to about 10, with r being 0 when neither a polyalkyleneoxy group nor a cationic group is part of the polymer backbone; when one or more polyalkyleneoxy groups and/or cationic groups are part of the polymer backbone, the r to (m+p) ratio ranges typically from about 1:1000 to about 1:2, preferably from about 1:500 to about 1:4, more preferably from 1:200 to about 1:8, and even more preferably from about 1:100 to about 1:20;

wherein said silicone polymer can be linear, branched, and/or cyclic, preferably linear or branched, and more preferably linear; and wherein different $—O—SiR_2—$, $—O—SiRB—$, $—O—SiRD—$, and $—[OSiR_2—J—(G)_g—(J)_j—(E)_k—J—SiR_2]—$ groups can be distributed randomly in the silicone backbone and/or organized as block copolymers of different degrees.

A nonlimiting example of aminofunctional silicone polymers conforms with the formula:

$$(CH_3)_3Si—[O—Si(CH_3)_2]_n—\{OSi(CH_3)[(CH_2)_3—NH—(CH_2)_2]\}_m—OSi(CH_3)_3$$

wherein the sum of n+m is a number from 2 to about 1,000.

Nonlimiting examples of aminofunctional silicone polymers comprising optional polyalkyleneoxy groups include those disclosed in U.S. Pat. No. 5,098,979, issued Mar. 24, 1992 to O'Lenick disclosing some silicones with cationic capped polyalkyleneoxy pendant groups, and U.S. Pat. No. 5,196,499, issued Mar. 23, 1993 to O'Lenick disclosing some silicones with cationic capped polyalkyleneoxy terminal groups, said patents are incorporated herein by reference.

Reactive, Curable Silicones.

Reactive, curable silicone polymers comprise one or more reactive Si functional groups including Si—H, Si—OH, Si—OR and/or Si—OCOR groups, wherein R is typically a low molecular weight alkyl group. Each reactive Si bearing a reactive functional group can be a terminal group, a pendant group, part of the silicone backbone, and mixtures thereof.

The reactive, curable silicones of the present invention conform to the following general structure II:

$$(R^1)_aR_{3-a}Si—(—O—SiR_2)_m—(—O—SiRA)_n(—O—SiRB)_p—(—O—SiRD)_q[OSiR_2—J—(G)_g—(J)_j—(E)_k—J—SiR_2]_r—O—Si(R^1)_bR_{3-b} \quad (II)$$

wherein:

each R group is the same or different and is preferably an alkyl, aryl, and mixtures thereof, more preferably, each R is methyl, ethyl, propyl, butyl, or phenyl group, most preferably R is methyl;

each A of the Si reactive functional group is the same or different and is preferably selected from the group consisting of hydrogen, —OH, —OR, $—OCOCH_3$, $—CH_2CH_2Si(OR)_3$, $—CH_2CH_2Si(OR)_2R$, $—CH_2CH_2Si(OR)R_2$, and mixtures thereof.

each optional, but preferred cationic B group is an —X—E group with each X being a hydrocarbon or oxygenated hydrocarbon linking group, preferably being selected from the group consisting of $—CH_2CH_2CH_2—$, $—CH_2CH(CH_3)CH_2—$, $—CH_2CH_2—$, $—CH_2CH(OH)CH_2OCH_2CH_2CH_2—$, and $—CH_2$-phenylene-$CH_2CH_2—$, and mixtures thereof; and each E being a cationic nitrogen functional group, preferably being selected from the group consisting of amino group and quaternary ammonium derivatives thereof; cyclic amino group and quaternary ammonium derivatives thereof, imidazole group and imidazolium derivatives thereof; imidazoline group and imidazolinium derivatives thereof, polycationic group; and mixtures thereof, each optional, but preferred D group is a poly(ethyleneoxy/propyleneoxy) group having the general structure:

$$—Z—O(C_2H_4O)_c(C_3H_6O)_dR^3$$

wherein each Z is a linking group, preferably selected from the group consisting of hydrocarbon or oxygenated hydrocarbon linking group, e.g., $—CH_2CH_2CH_2—$, $—CH_2CH(CH_3)CH_2—$, $—CH_2CH_2—$, $—CH_2CH(OH)CH_2OCH_2CH_2CH_2—$, -phenylene-$CH_2CH_2—$ and $—CH_2$-phenylene-$CH_2CH_2—$; aminohydrocarbon linking group, e.g., $—CH_2CH_2CH_2—N<$ group and $—CH_2CH(CH_3)CH_2—N<$ group; and mixtures thereof; each $R^3$ group is the same or different and being preferably selected from the group consisting of hydrogen, R, JE, $—CH_2CH(R)OH$, $—CH_2C(R)_2OH$, $—CH_2CH(OH)CH_2OR$, $—CH_2CH(OH)CH_2(OCH_2CH_2)_eOR$, tetrahydropyranyl, —CH(R)OR, C(O)H, and/or —C(O)R group, more preferably $R^3$ group is an R group, with R being more preferably selected from methyl and/or ethyl group; each c is at least 2, preferably at least about 5, more preferably at least about 11, even more preferably at least about 21, total c (for all polyalkyleneoxy side groups) has a value of from about 4 to about 2500, preferably from about 6 to about 1000, more preferably from about 11 to about 800, and even more preferably from about 21 to about 500; total d is from 0 to about 1000, preferably from 0 to about 300; more preferably from 0 to about 100, and even more preferably d is 0; total c is preferably equal or larger than total d; total c+d has a value of from about 4 to about 2500, preferably from about 8 to about 800, and more preferably from about 15 to about 500; and each e is from 1 to about 20, preferably 1 or 2;

each optional G is $—O(C_2H_4O)_v(C_3H_6O)_w—$; each J is selected from X and $—CH_2CH(OH)CH_2—$; each optional E is a cationic group defined as hereinabove; each v is from 0 to about 200, preferably from about 5 to about 150, more preferably from about 11 to about 120, and even more preferably from about 20 to about 100; each w is from 0 to about 50 and preferably v is equal or larger than w; each g and k is from 0 to about 10, preferably from 0 to about 6, more preferably from about 1 to about 3, and even more preferably from about 1 to about 2; j is g+k−1, providing that no O—O bonds are formed;

each $R^1$ group is the same or different and is preferably selected from the group consisting of R, A, B, and/or D group;

each a and/or b is an integer from 0 to 3, preferably 2, more preferably 1;

m is from about 5 to about 1600, preferably from about 6 to about 800, more preferably from about 8 to about 400, and even more preferably from about 10 to about 200;

n, a, and b, and the $R^1$ groups of the terminal groups $(R^1)_aR_{3-a}Si—O—$ and $O—Si(R^1)_bR_{3-b}$ are selected such that the silicone polymer comprises at least one reactive Si functional group in the form of an Si—A group, preferably Si—H, Si—OH, Si—OR, Si—OCOR, and mixtures thereof, with R preferably a methyl group; and more preferably the silicone molecule comprises at least about two reactive Si functional groups; with typically the n to (m+n) ratio (and the n to (m+n+p) ratio when p is not 0), ranges from 0 to about 1:2, preferably from about 1:1500 to about 1:3, more preferably from about 1:400 to about 1:4, and even more preferably from about 1:100 to about 1:4;

p, a, and b, and the $R^1$ groups of the terminal groups $(R^1)_aR_{3-a}Si—O—$ and $O—Si(R^1)_bR_{3-b}$ are selected such that the silicone polymer optionally comprises at least one cationic group in the form of an Si—B group; with typically the p to (m+n+p) ratio ranges from 0 to about 1:2, preferably from about 1:200 to about 1:3, more preferably from about 1:100 to about 1:4, and even more preferably from about 1:50 to about 1:4; and q, a, and b, and the $R^1$ groups of the terminal groups $(R^1)_aR_{3-a}Si—O—$ and $O—Si(R^1)_bR_{3-b}$ are selected such that the silicone polymer optionally comprises at least one poly(ethyleneoxy/propyleneoxy) Si—D group; and preferably at least about two Si—D groups; with typically the q to (m+n+p) ratio ranges from about 1:1000 to about 1:3, preferably from about 1:200 to about 1:4, more preferably from about 1:100 to about 1:4, and even more preferably from about 1:50 to about 1:5;

r is from 0 to about 100, preferably from 1 to about 20, more preferably from 1 to about 10, with r being 0 when neither a polyalkyleneoxy group nor a cationic group is part of the polymer backbone; when one or more polyalkyleneoxy groups and/or cationic groups are part of the polymer backbone, the r to (m+n+p) ratio ranges typically from about 1:1000 to about 1:2, preferably from about 1:500 to about 1:4, more preferably from 1:200 to about 1:8, and even more preferably from about 1:100 to about 1:20;

wherein said silicone polymer can be linear, branched, and/or cyclic, preferably linear or branched, and more preferably linear; and wherein different $—O—SiR_2—$, —O—SiRA—, —O—SiRB—, —O—SiRD—, and $—[OSiR_2—J—(G)_g—(J)_j—(E)_k—J—SiR_2]—$ groups can be distributed randomly in the silicone backbone and/or organized as block copolymers of different degrees.

Simple reactive silicones that do not have amino functional groups and polyalkyleneoxy groups are also suitable for use in the composition of the present invention. Nonlimiting examples of this class include polyalkyl and/or phenyl silicone fluids with the following structure:

$$A—Si(R_2)—O—[Si(R_2)—O—]_q—Si(R_2)—A$$

The alkyl groups substituted on the siloxane chain (R) or at the ends of the siloxane chains (A) can have any structure as long as one or more A and/or R groups is hydrogen, hydroxy, hydroxyalkyl group, such as methoxy, ethoxy, propoxy, and aryloxy group, acyloxy group, and mixtures thereof. Thus, each R group preferably can be alkyl, aryl, hydroxy, or hydroxyalkyl group, and mixtures thereof; preferably the nonreactive R group is methyl. Each A group which blocks the ends of the silicone chain can be hydrogen, methyl, methoxy, ethoxy, hydroxy, propoxy, or aryloxy group, acyloxy group, and mixtures thereof; preferably the nonreactive R group is methyl. Suitable A groups include hydrogen, methyl, methoxy, ethoxy, hydroxy, and propoxy. q is preferably an integer from about 7 to about 8,000. An example of commercially available silicones of this class is General Electric 176-12669 aqueous emulsion which comprises about 30% to about 60% of a curable silicone having Si—OH reactive groups, and emulsified by a mixture of cationic and nonionic emulsifiers.

Preferably, curable silicones of the present invention comprise cationic aminofunctional groups or polyalkyleneoxy groups, more preferably comprising both cationic aminofunctional groups and polyalkyleneoxy groups.

A nonlimiting example of curable aminofunctional silicone material has the formula:

$$RO—[Si(CH_3)_2—O]_x—\{Si(OH)[(CH_2)_3—NH—(CH_2)_2—NH_2]O\}_y—R$$

wherein each R is hydrogen, low molecular weight alkyl group, such as, methyl, propyl, butyl, low molecular weight acyl, such as $CH_3CO$, and mixtures thereof, x and y are integers which depend on the molecular weight of the silicone. This material is also known as "amodimethicone". These aminofunctional silicones are reactive, and can further condense to form higher molecular weight polymers and/or form bonds with the fabrics, and are thus highly substantive to fabrics. Examples of this class of materials are described in U.S. Pat. No. 4,911,852 issued Mar. 27, 1990 to Coffindaffer et al., said patent is incorporated herein by reference. A commercially available curable aminofunctional silicone is disclosed in this patent, namely, SF 1706 neat silicone, available from General Electric Company; this silicone comprises terminal reactive $Si—OCH_3$ groups, and pendant $—CH_2CH_2CH_2NHCH_2CH_2NH_2$ cationic groups, and is available as specialty aqueous emulsion 124–7300 containing about 20% SF 1706. Another example is an aqueous General Electric SM 2658 emulsion comprising about 30% to about 60% of curable aminofunctional silicone with terminal reactive Si—OH groups, and pendant $—CH_2CH_2CH_2NHCH_2CH_2NH_2$ cationic groups, emulsified by cationic surfactants.

Preferred Enduring Hydrophilic Silicones.

Typical curable silicones, including curable amine functional silicones, are surface substantive and make the treated surface very hydrophobic. However, for normal usage, waterproofing of garments and other household fabrics such as towels is also not desirable and should be avoided. Therefore, it is desirable for fabric care to have silicone polymers as surface modifiers that keep or make the treated surface hydrophilic. Thus the present invention preferably relates to curable silicones that are surface substantive, but do not have the hydrophobicity negative. The preferred hydrophilic curable silicones of formula II of the present invention comprise poly(alkyleneoxy) D groups, and preferably said poly(ethyleneoxy) D groups are exposed on the treated surface, and not being concealed and hidden within and/or underneath the silicone coating layer, in order to provide the surface hydrophilicity. This is achieved by (a) having the poly(ethyleneoxy) groups capped with a $C_1$–$C_4$ alkyl group, a hindered alcohol group, or a protected alcohol group, to prevent the poly(ethyleneoxy) groups from reacting with the reactive Si—A groups to become part of the backbone and/or cross-linking groups, and (b) not having the poly(ethyleneoxy) groups capped with cationic E groups if the poly(ethyleneoxy) groups are short, since cationic E groups are believed to have the tendency to anchor deep on the treated surface and thus also driving the poly (ethyleneoxy) groups deep underneath the silicone coating layer. To effectively avoid or reduce the crosslinking by the poly(alkyleneoxy) D groups, any capping alcohol group needs to have the OH group well protected; therefore tertiary alcohol groups such as —$CH_2C(R_2)OH$ or hindered secondary alcohol groups, such as —$CH_2CH(R^4)(OH)$, with $R^4$ not being H or $CH_3$, are preferred.

However, it will be appreciated that large poly(ethylene oxide) groups are less needful of these capping group restrictions, since they are less likely to be completely covered by the silicone segments in the cured layer. Thus, the present invention also relates to hydrophilic curable silicones with uncapped pendant poly(alkyleneoxy) D groups (i.e., poly(alkyleneoxy) D groups terminated by a —OH) and/or capped with cationic E groups to increase crosslinking and/or surface substantivity, wherein each pendant poly(alkyleneoxy) D group preferably comprises at least about 11 ethyleneoxy units (i.e., c being equal or greater than about 11), more preferably at least about 15 ethyleneoxy units (c being equal or greater than about 15), more preferably at least about 21 ethyleneoxy units (c being equal or greater than about 21), and even more preferably at least about 30 ethyleneoxy units (c being equal or greater than about 30). Similarly, when internal poly(ethyleneoxy) G groups which form part of the polymer backbone are desirable, each G group should preferably comprise at least about 11 ethyleneoxy units (i.e., v being equal or greater than 11), more preferably at least about 15 ethyleneoxy units (v being equal or greater than 15), and more preferably at least about 30 ethyleneoxy units (v being equal or greater than 30).

The present invention also preferably relates to noncurable aminofunctional silicones of formula I that comprise hydrophilic poly(alkyleneoxy) D groups. These noncurable cationic silicone polymers can provide an intermediate durability benefit which is preferred in some applications. Said noncurable cationic silicone polymers comprise poly (ethyleneoxy) D pendant and/or terminal groups that are exposed on the treated surface, and not being concealed and hidden within and/or underneath the silicone coating layer, in order to provide the surface hydrophilicity. This is achieved by (a) having the poly(ethyleneoxy) pendant groups not capped with cationic functional capping groups, (b) when cationic functional groups are needed on the poly(ethyleneoxy) pendant groups, e.g., for improved surface substantivity, each pendant poly(alkyleneoxy) D group should comprise at least about 11 ethyleneoxy units (i.e., c being equal or greater than about 11), more preferably at least about 15 ethyleneoxy units (c being equal or greater than about 15), more preferably at least about 21 ethyleneoxy units (c being equal or greater than about 21), and even more preferably at least about 30 ethyleneoxy units (c being equal or greater than about 30), and/or (c) when internal poly(ethyleneoxy) G groups which form part of the polymer backbone are present, each G group should preferably comprise at least about 11 ethyleneoxy units (i.e., v being equal or greater than about 11), more preferably at least about 15 ethyleneoxy units (v being equal or greater than about 15), more preferably at least about 21 ethyleneoxy units (c being equal or greater than about 21), and even more preferably at least about 30 ethyleneoxy units (v being equal or greater than 30).

Reactive, Curable Silicones Comprising Polyalkyleneoxy Groups, but not Cationic Amino Functional Groups.

Reactive, curable silicone polymers comprising polyalkyleneoxy groups, but not cationic amino functional groups are also useful in the compositions of the present invention. Said silicone polymers have the following general structure III:

$$(R^1)_aR_{3-a}Si—(—O—SiR_2)_m—(—O—SiRA)_n—(—O—SiRD)_q—[OSiR_2—J—(G)_g—J—SiR_2]_v—O—Si(R^1)_bR_{3-b} \quad \text{(III)}$$

These silicones are similar to those having structure II hereinabove, except that they do not comprise cationic E groups. Again in this case, the pendant and/or internal poly(ethyleneoxy) D groups should be long enough, preferably comprises at least about 11 ethyleneoxy units (i.e., c being equal or greater than about 11), more preferably at least about 15 ethyleneoxy units (c being equal or greater than about 15), more preferably at least about 21 ethyleneoxy units (c being equal or greater than about 21), and even more preferably at least about 30 ethyleneoxy units (c being equal or greater than about 30); and/or the pendant and/or internal poly(ethyleneoxy) D groups should be capped with a $C_1$–$C_4$ alkyl group, a hindered alcohol group, or a protected alcohol group, to prevent the poly (ethyleneoxy) groups from reacting with the reactive Si—A groups; and mixtures thereof.

A nonlimiting example of reactive silicones of this class is the water soluble Silwet® L-720 polyalkyleneoxylated silicones with terminal reactive Si—O—$R^1$ groups, and butyl-capped polyethyleneoxy/polypropyleneoxy block copolymer pendant groups, with about equal number of ethyleneoxy and propyleneoxy units, and with an average molecular weight of about 12,000, and is available from CK Witco, Greenwich, Conn.

Following are nonlimiting examples of hydrophilic curable silicones useful in the compositions of the present invention. These materials are prepared from intermediate materials that can be prepared as follows:

Alkoxylated Allyl Alcohols

Ethoxylated(5) Allyl Alcohol, Intermediate Material A

To a 250 ml, three neck, round bottom flask equipped with a magnetic stirring bar, condenser, thermometer, and temperature controller (Therm-O-Watch®, $I^2R$) is added allyl alcohol (Aldrich, about 24.5 g, about 0.422 mol, from Aldrich, Milwaukee, Wis.) under argon. Sodium metal (Aldrich, about 0.78 g, about 0.034 mol) is added in three increments. An exotherm occurs (about 60° C.), and after the sodium is dissolved, the solution is heated to about 80° C. Ethylene oxide gas is added via a sparging tube with rapid stirring. The temperature of the system is kept below about 130° C. during the addition of ethylene oxide, which is stopped when a weight gain of about 77.3 g, corresponding to about 4.2 ethoxy units, is obtained. A $^1$H-NMR($CDCl_3$) shows resonances for the allyl peaks at ~5.9 ppm ($CH_2$=C$\underline{H}$—), ~5.2 ppm ($C\underline{H}_2$=CH—), and ~4 ppm ($CH_2$=CHC$\underline{H}_2$—), and a large resonance for the hydrogens from the ethoxy groups at ~3.5–3.8 ppm. Integration of these peaks indicates that the degree of ethoxylation is about 5. The material is neutralized to about pH 7 with methanesulfonic acid (Aldrich). The resulting salt is removed by gravity filtration of the neat material.

Ethoxylated(10) Allyl Alcohol, Intermediate Material B.

The preparation of Intermediate Material A is repeated except that it is conducted in a stirred autoclave and the total ethylene oxide condensed is increased to give the desired $H(OCH_2CH_2)_nOCH_2CH{=}CH_2$ with average n of about 10.

Ethoxylated (24) Allyl Alcohol, Intermediate Material B1.

The preparation of Intermediate Material A is repeated except that the total ethylene oxide condensed is increased to give the desired $H(OCH_2CH_2)_nOCH_2CH{=}CH_2$ with average n of about 24.

Alkoxylated Allyl Alcohol, Intermediate Material C.

The preparation of Intermediate Material A is repeated in the autoclave except that propylene oxide is first condensed with the allyl alcohol and when an average of about 3 units have been condensed, ethylene oxide is condensed until a total average of about 3 propylene oxides and about 7 ethylene oxides have been condensed per allyl alcohol to give the desired final mixed alkoxylate, $H(OCH_2CH_2)_n(OCH(CH_3)CH_2)_mOCH_2CH{=}CH_2$ with average n of about 7 and average m of about 3.

Ethoxylated Ally Amines

Allyldiethanolamine, Intermediate Material D.

Allyl amine (about 228 g, about 4.0 mol, Aldrich) is placed in a 2 liter, stirred autoclave and is heated to about 100° C. under about 200 psi pressure of nitrogen gas. Ethylene oxide (about 352 g, about 8.0 mol, Balchem Corp., State Hill, N.Y.) is gradually pumped into the system with care to keep the temperature in the 90–110° C. range. After the pressure stabilizes, the autoclave is cooled to room temperature and depressurized. Then, about 435 g of the resulting hydroxyethylated amine (allyldiethanolamine) is removed from the autoclave.

Ethoxylated Allyl Amine, Intermediate Material E.

The approximate 145 g (about 1 mol) of allyldiethanolamine D remaining in the autoclave is treated with about 21.6 g (about 0.1 mol) of 25% sodium methoxide in methanol (Aldrich) and the methanol is removed from the system by stirring and applying vacuum and gradually raising the temperature to about 100° C. After the methanol is removed, ethylene oxide is added gradually, keeping the temperature in the 100–110° C. range. Addition is continued until a total of about 8 moles of ethylene oxide has been added during the base catalyzed phase of the ethoxylation. After the pressure stabilizes, the system is cooled to about 50° C. and about 248 g (about 0.5 mol) of ethoxylated allylamine is withdrawn and the strong base is neutralized by adding about 0.05 moles of methanesulfonic acid to give the desired product, $CH_2{=}CHCH_2N[(CH_2CH_2O)_nH]_2$ with average n of about 5.

Ethoxylated Allyl Amine, Intermediate Material F.

About 0.5 moles of the ethoxylated product E remaining in the autoclave is again raised to about 100° C. and about 220 g (about 5 mol.) ethylene oxide is condensed under the same conditions used previously. After the pressure stabilizes, the autoclave is cooled and about 234 g of the product is removed and neutralized as before. to give the desired product, $CH_2{=}CHCH_2N[(CH_2CH_2O)_nH]_2$ with average n of about 10.

Ethoxylated Allyl Amine, Intermediate Material F1.

About 0.25 moles of the ethoxylated product remaining in the autoclave is again raised to about 100° C. and about 264 g (about 6 mol.) ethylene oxide is condensed under the same conditions used previously. After the pressure stabilizes, the autoclave is cooled and the product is removed and neutralized as before to give the desired product, $CH_2{=}CHCH_2N[(CH_2CH_2O)_nH]_2$ with average n of about 22.

Etherification of Ethoxylated Allyl Amine

Methyl Capped Ethoxylated Allyl Amine, Intermediate Material G.

Ethoxylation of allylamine is conducted as described in the above example to prepare a sample of about 497 g (about 1 mol.) $CH_2{=}CHCH_2N[(CH_2CH_2O)_nH]_2$ with average n=5 (Intermediate Material E). However, in this case, the ethoxylated reaction product is not removed from the autoclave, but is further treated with about 216 g (about 1.0 mol) of 25% sodium methoxide in methanol and then the methanol is completely stripped from the autoclave by applying vacuum and raising the temperature gradually to about 100° C. with good stirring. After the methanol is removed, the reaction mixture is cooled to room temperature and about 500 ml of tetrahydrofuran is added, followed by gradually adding about 50.5 g (about 1.0 mol.) chloromethane (Aldrich). The reaction mixture is stirred vigorously and after the initial exotherm, the temperature is raised and held at about 60° C. for one hour. Then an additional about 1.0 moles of sodium methoxide is added and the methanol and tetrahydrofuran are removed under vacuum as before. Tetrahydrofuran is again added as a solvent and another 50.5 g (about 1.0 mol.) of chloromethane is added as before and allowed to react. After the chloromethane has reacted, the reaction mixture is removed from the autoclave and salts are removed by filtration. The tetrahydrofuran is removed by stripping under vacuum to yield an oil from which a small amount of additional salt is removed by filtration to give the desired methyl capped, ethoxylated allylamine, $CH_2{=}CHCH_2N[(CH_2CH_2O)_nCH_3]_2$ with average n of about 5.

Methyl Capped Ethoxylated Allyl Amine, Intermediate Materials G1 and G2.

The process is repeated with the more highly ethoxylated samples F and F1 of allylamine prepared earlier to give the desired capped materials, $CH_2{=}CHCH_2N[(CH_2CH_2O)_nCH_3]_2$, with average n of about 10 and 22, respectively.

Hydroxyisobutyl Capped Ethoxylated Allylamine, Intermediate Material H.

Ethoxylation of allylamine is repeated as described above, but after the ethoxylation has reached a degree of about 10, the $CH_2{=}CHCH_2N[(CH_2CH_2O)_nH]_2$ (n=about 10, Intermediate Material F) in the autoclave still containing strong alkaline catalyst, is further treated with two moles of isobutene oxide (BASF) for each mole of ethoxylated intermediate. Heating is continued at about 100–110° C. until all the isobutene oxide is consumed and the reaction mixture is then cooled and removed from the reactor and the strong base catalyst is neutralized by adding methanesulfonic acid. This produces the desired ethoxylated allylamine with hindered alcohol termini, $CH_2{=}CHCH_2N[(CH_2CH_2O)_n{-}CH_2C(OH)(CH_3)_2]_2$, with average n of about 10.

Ethoxylated Allylamine with Hindered Alcohol Capping Group Derived from a Glycidyl Ether, Intermediate H1.

Ethoxylation of allylamine is repeated as described above, but after the ethoxylation has reached a degree of about 10, the $CH_2{=}CHCH_2N[(CH_2CH_2O)_nH]_2$ (n=about 10, Intermediate Material F) in the autoclave still containing strong alkaline catalyst, is further treated with two moles of glycidyl methyl ether for each mole of ethoxylated intermediate. Heating is continued at about 100–110° C. until all the glycidyl methyl ether is consumed and the reaction mixture is then cooled and removed from the reactor and the strong base catalyst is neutralized by adding methanesulfonic acid. This produces the desired ethoxylated allylamine with hindered alcohol termini, $CH_2{=}CHCH_2N[(CH_2CH_2O)_n{-}CH_2C(OH)CH_2OCH_3]_2$ with average n of about 10.

Ether Capping of Alkoxylated Allyl Alcohol

Methyl Capped Ethoxylated Allyl Alcohol, Intermediate Material J.

A portion of about 27.8 g (about 0.1 mole) of allyl alcohol with degree of ethoxylation equal to about 5 (Intermediate Material A) is dissolved in about 200 ml of tetrahydrofuran in a 500 ml round bottom flask equipped with magnetic stirring, condenser and set up for blanketing with argon. Sodium hydride (about 2.7 g, about 0.11 mol.) is added in portions to the stirred reaction mixture and after the initial exotherm, mild heating to about 50° C. is continued until gas evolution stops. The reaction mixture is cooled to about 10°

C. and the condenser is replaced by a solid $CO_2$ condenser. Then, gaseous methyl bromide is passed into the reaction mixture until an excess is present and the reaction mixture is stirred and the temperature is allowed to rise to near room temperature. After about 4 hours, the reaction mixture is filtered and then the solvent is removed under vacuum on a rotary evaporator to leave the desired methyl ether of ethoxylated allyl alcohol, $CH_3(OCH_2CH_2)_n OCH_2CH{=}CH_2$ with average n of about 5.

Methyl Capped Ethoxylated Allyl Alcohol, Intermediate Material J1 and J2.

The same procedure is repeated with the more highly ethoxylated allyl alcohols prepared as described (Intermediates B and B1) to give additional samples of $CH_3(OCH_2CH_2)_n OCH_2CH{=}CH_2$ with average n of about 10 and 24, respectively.

Methyl Capped Alkoxylated Allyl Alcohol, Intermediate J3.

The same procedure is applied to Intermediate Material C to obtain the corresponding methyl ether of the mixed propoxylated-ethoxylated allyl alcohol.

Hindered Alcohol-Capped Ethoxylated Allyl Alcohol, Intermediate J4.

Allyl alcohol is ethoxylated in an autoclave as previously described to an ethoxylation degree of about 20. Prior to neutralizing the basic catalyst, the ethoxylated material is further treated with 1 mole of isobutene oxide (BASF) for each mole of ethoxylated intermediate. Heating is continued at about 100–110° C. until all the isobutene oxide is consumed and the reaction mixture is then cooled and removed from the reactor and the strong base catalyst is neutralized by adding methanesulfonic acid, This produces the desired ethoxylated(20) allyl alcohol capped with a $—CH_2C(CH_3)_2(OH)$ group.

Tetrahydropyranyl Ether of Ethoxylated Allyl Alcohol

Tetrahydropyranyl Ether of Ethoxylated Allyl Alcohol, Intermediate Material K.

A portion of about 27.8 g (about 0.1 mole) of allyl alcohol with degree of ethoxylation equal to about 5 (Intermediate Material A) is dissolved in about 50 ml of methylene chloride in a 250 ml round bottom flask equipped with magnetic stirring, condenser and set up for blanketing with argon. Then, 3,4-dihydro-2H-pyran (about 16.8 g, about 0.2 mol, Aldrich) is added along with about 0.1 g p-toluenesulfonic acid monohydrate (Aldrich) and the system is allowed to stir at room temperature for about 6 hours. The acid catalyst is neutralized by adding a small excess of base in the form of about 0.15 g of 25% sodium methoxide in methanol (Aldrich) and the solvent and excess dihydropyran are stripped off on the rotary evaporator and salts are removed by filtration to yield the desired tetrahydropyranyl ether, THP-$(OCH_2CH_2)_n OCH_2CH{=}CH_2$ with average n of about 5.

Intermediate Material K1 and K2.

The preparation of Intermediate Material K is repeated except that ethoxylated allyl alcohols with degree of ethoxylation of about 10 and 24 (Intermediate Materials B and B1) are used to give the desired tetrahydropyranyl ethers of ethoxylated (10) allyl alcohol and ethoxylated (24) allyl alcohol, Intermediate Materials K1 and K2.

Allyl Ether of Imidazole Ethoxylate

Intermediate Material M.

Allyl alcohol is ethoxylated using basic catalysis to a degree of about 10. A portion of about 49.8 g (about 0.10 mol) of the resulting allyl ethoxylate is placed in a 250 ml round bottom flask equipped with reflux condenser, dropping funnel, magnetic stirring and argon blanketing, and about 1 g of N,N-dimethylformamide (Aldrich) is added. Then the reaction mixture is heated to about 70° C. with vigorous stirring as about 14.3 g (about 0.12 mol) thionyl chloride is added dropwise over about one hour. Heating is continued for about 18 hour and the excess thionyl chloride is removed by stripping on a rotary evaporator. The resulting oil is then added with vigorous stirring to a 500 ml round bottom flask containing about 80 g (about 1.0 mol) of imidazole and the reaction mixture is heated to about 80° C. and held there for about 18 hours. The reaction mixture is cooled and about 21.6 g (about 0.1 mole) of about 25% sodium methoxide in methanol is added and then the methanol and excess imidazole are stripped off on the rotary evaporator and the kugelrohr to give an oil with a salt precipitate. The salt is removed by filtration to yield the imidazole-terminated allyl ethoxylate, $CH_2{=}CHCH_2(OCH_2CH_2)_n$-imidazole where average n is about 10.

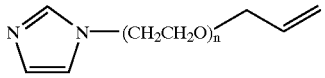

Hydrosilation of Ethers of Ethoxylated Allyl Alcohol with Alkoxysilanes

Intermediate Hydrosilation Material N.

A portion of about 29.2 g (about 0.1 mol.) of $CH_3(OCH_2CH_2)_n OCH_2CH{=}CH_2$ with average n of about 5 (Intermediate Material J) is placed in a 250 ml round bottom flask equipped with magnetic stirring, distillation head, dropping funnel, and argon blanketing and about 125 ml of toluene is added. The solution is brought to a boil and about 25 ml of toluene is distilled out along with traces of moisture. The distillation head is replaced with a reflux condenser, about 0.1 g (about 0.00024 mol.) chloroplatinic acid (Aldrich) is added, and the solution is brought to reflux. Then about 20 g triethoxysilane (about 0.12 mol, Aldrich) is added dropwise over about 30 minutes and the reflux is continued for about 4 hours. The reaction mixture is cooled and the solvent and excess silane are stripped on a rotary evaporator to give the desired hydrosilated product, $CH_3(OCH_2CH_2)_n OCH_2CH_2CH_2Si(OCH_2CH_3)_3$ with n of about 5

Intermediate Hydrosilation Material N1.

The procedure for preparing Intermediate Material N is repeated except methyldiethoxysilane is substituted for the triethoxysilane. This yields the desired diethoxysilane, $CH_3(OCH_2CH_2)_n OCH_2CH_2CH_2Si(CH_3)(OCH_2CH_3)_2$ with average n of about 5.

Hydrosilation of Ethers of Ethoxylated Allyl Alcohol with Cyclic Hydrosiloxanes

Intermediate Hydrosilation Material O.

A portion of about 51 g (about 0.1 mol.) portion of $CH_3(OCH_2CH_2)_n OCH_2CH{=}CH_2$ with n of about 10, prepared as above (Intermediate Material J1) is placed in a 250 ml. round bottom flask equipped with magnetic stirrer, argon blanketing, and a distillation head. A portion of about 100 ml. of toluene is added and about 25 ml. of toluene are distilled off to dry the system. The distillation head is replaced by a reflux condenser. A portion of about 6 g (about 0.025 mol.) of 1,3,5,7-tetramethylcyclotetrasiloxane (Gelest Inc., Tullytown, Pa. is added along with about a 20 $\mu$L portion of platinum-divinyltetramethyldisiloxane complex in xylene (Gelest), and the reaction mixture is heated to reflux for about 5 hours. After reflux, an aliquot shows an NMR spectrum that indicates substantially all the allyl groups have reacted. The solvent is stripped off to yield the desired ethoxylate-substituted cyclotetrasiloxane, $[Si(O)(CH_3)CH_2CH_2CH_2(OCH_2CH_2)_{10}OCH_3]_4$.

Intermediate Hydrosilation Material P.

The synthesis of Intermediate Material O is repeated except that the methyl capped ether is replaced by the tetrahydropyranyl-capped ether, THP-$(OCH_2CH_2)_n$ $OCH_2CH{=}CH_2$ (Intermediate Material K1) with average n of about 10, prepared as above. A portion of about 0.5 g of triethylamine is also added to ensure that the system remains slightly alkaline. This yields the desired THP-capped ethoxylate-substituted cyclotetrasiloxane, $[Si(O)(CH_3)$ $CH_2CH_2CH_2(OCH_2CH_2)_{10}O\text{-}THP]_4$.

Intermediate Hydrosilation Material P1.

The synthesis is repeated, except that more highly ethoxylated THP ether (Intermediate Materials K2), is used to obtained the desired cyclotetrasiloxane $[Si(O)(CH_3)$ $CH_2CH_2CH_2(OCH_2CH_2)_{22}O\text{-}THP]_4$.

Hydrosilation of Ethers of Ethoxylated Allylamine with Cyclic Hydrosiloxanes

Intermediate Hydrosilation Material Q.

A portion of about 52.5 g (about 0.1 mol.) of $CH_2{=}CHCH_2N[(CH_2CH_2O)_nCH_3]_2$ with average n of about 5, prepared as above (Intermediate Material G) is placed in a 250 ml. round bottom flask equipped with magnetic stirrer, argon blanketing, and a distillation head. A portion of about 100 ml. of toluene is added and about 25 ml. of toluene is distilled off to dry the system. The distillation head is replaced by a reflux condenser. A portion of about 6 g (about 0.025 mol.) of 1,3,5,7-tetramethylcyclotetrasiloxane (Gelest) is added along with a 20 $\mu$L portion of platinum-divinyltetramethyldisiloxane complex in xylene (Gelest), and the reaction mixture is heated to reflux for about 8 hours, after which an aliquot shows an NMR spectrum that indicates substantially all the allyl groups have reacted. The solvent is stripped off to yield the desired aminoethoxylate-substituted cyclotetrasiloxane, $[Si(O)(CH_3)CH_2CH_2CH_2N\{(OCH_2CH_2)_5OCH_3\}_2]_4$.

N-Allylethylenediamine

Intermediate Material R.

A portion of about 120 g (about 2.0 mol.) of ethylenediamine is dissolved in about 300 ml of tetrahydrofuran in a 1000 ml round bottom flask equipped with magnetic stirring, reflux condenser and argon blanketing. A portion of about 76 g (about 1.0 mol.) of allyl chloride is added dropwise with good stirring over about one hour and then the system is brought to reflux for about 30 minutes. The reaction mixture is stripped to near dryness and about 300 ml of water and about 41 g (about 1.02 equivalents) sodium hydroxide is added with care to make the system strongly basic. The resulting solution is cooled to room temperature and extracted twice with about 200 ml portions of diethyl ether. The ether extracts are combined and dried over sodium sulfate and then fractionally distilled to yield a major fraction consisting of N-allylethylenediamine intermediate material suitable for use in hydrosilation reactions.

Hydrosilation of Allylethylenediamine by Cyclic Hydrosiloxanes

Intermediate Hydrosilation Material S.

A portion of about 24 g (about 0.1 mol.) of 1,3,5,7-tetramethylcyclotetrasiloxane (Gelest) is dissolved in about 100 ml of dry toluene in a 250 ml, round bottom flask equipped with magnetic stirrer, reflux condenser and argon blanketing. A portion of about 40 g (about 0.40 mol.) of allylethylenediamine made as described above (Intermediate Material B) is added along with a portion of about 0.2 g (about 0.0005 mol.) chloroplatinic acid (Aldrich), and the system is heated to reflux for about 4 hours. At this point, an aliquot examined by proton NMR shows that the resonances associated with the allyl group are substantially gone. The solvent is stripped off to yield the desired amino-functional cyclotetrasiloxane, $[Si(O)(CH_3)$ $(CH_2CH_2CH_2NHCH_2CH_2NH_2)]_4$.

Vinyl-Terminated Oligosiloxanes with Pendant Amino Functionality

Intermediate Material T. In a 1000 ml, round bottom flask equipped with magnetic stirring, dropping funnel, thermometer, and a short fractionation column topped by a distillation head, is placed about 260.5 g (about 2.0 mol) vinyldimethylethoxysilane (Gelest) and about 191.3 g (about 1.0 mol) 3-aminopropylmethyldiethoxysilane. The reaction is stirred at room temperature as about 36 g (about 2 mol) water is added dropwise. The temperature is gradually increased until ethanol is being distilled from the reaction mixture and held at about 120° C. until no further ethanol is evolved. This gives the desired intermediate

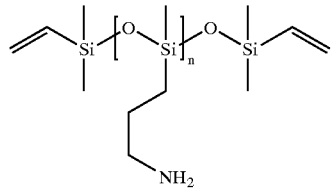

where the average value of n is about 1.

Preparation of Vinyl-Terminated Oligosiloxanes with Pendant Ethoxylate Functionality Intermediate Material U.

In a 1000 ml, round bottom flask equipped with magnetic stirring, dropping funnel, thermometer, and a short fractionation column topped by a distillation head, is placed about 260.5 g (about 2.0 mol) vinyldimethylethoxysilane (Gelest) and about 426 g (about 1 mol) of the ethoxylate-substituted triethoxysilane prepared as above, $CH_3(OCH_2CH_2)_n$ $OCH_2CH_2CH_2Si(OCH_2CH_3)_3$ with n of about 5. (Intermediate Material N) The reaction mixture is stirred at room temperature as about 36 g (about 2 mol) water is added dropwise. The temperature is gradually increased until ethanol is being distilled from the reaction mixture and is held at about 120° C. until no further ethanol is evolved. This gives the desired intermediate

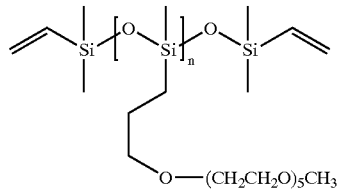

where the average value of n is about 1.

Polysiloxane Intermediates with Pendant Imidazole Groups

Intermediate Material V.

Following generally the method of Fortuniak and Chojnowski, Polym. Bull. (Berlin) (1997), 38(4), 371–378, N-allylimidazole hydrochloride is hydrosilated methyldichlorosilane to a high yield of N-[3-(methyldichlorosilyl) propyl]imidazole hydrochloride which is hydrolyzed under controlled conditions to give a mixture of cyclic and linear polysiloxanes with pendant imidazole groups having the general structure

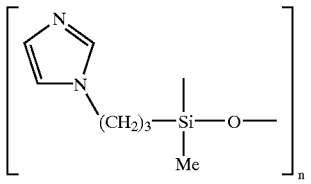

This mixture is used as intermediate V for incorporation of pendant imidazole groups into other polysiloxanes by re-equilibration.

Imidazole-Terminated Polydimethylsiloxane

Intermediate Material W.

In a 250 ml, round bottom flask equipped with magnetic stirrer, reflux condenser, and argon blanketing are placed about 45 g (about 0.1 mol, Gelest) hydride-terminated polydimethylsiloxane with molecular weight of about 450 and about 17.5 g (about 0.23 mol. Aldrich) allyl chloride and about 0.6 g (about 0.0015 mol, Aldrich) chloroplatinic acid. The reaction mixture is heated to about 90° C. with stirring for about 18 hours. Excess allyl chloride is stripped out on a kugelrohr apparatus to give the chloropropyl terminated oligomer. Then, imidazole (about 68 g, about 1 mol, Aldrich) and 50 ml of dioxane are added and the reaction mixture is heated under reflux for 16 hours. Then, the reaction mixture is cooled to room temperature and sodium methoxide (about 10.8 g, about 0.20 moles as a 25% solution in methanol) is added. After stirring and allowing to stand for about 3 hours, the system is filtered and the filtrate is stripped of solvent and excess imidazole on a rotary evaporator and then on a kugelrohr at 150° C. for 2 hours at a vaccum of about 1 mmHg. to give the desired imidazole-terminated silicone with average n equal to about 5.

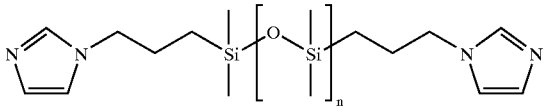

EXAMPLE I

Preparation of Curable Silicone with Both Amine and Polyalkyleneoxy Functionality by Silanol Condensation In a 500 ml round bottom flask equipped with mechanical stirring, fractionation column and argon blanketing, are placed about 150 ml toluene, about 80 g silanol terminated polydimethylsiloxane (about 0.2 mol, Gelest, nominal molecular weight=400), about 42.6 g (about 0.1 mol.) of the $CH_3(OCH_2CH_2)_nOCH_2CH_2CH_2Si(CH_3)(OCH_2CH_3)_2$ with average n of about 5 prepared as above (Intermediate Hydrosilation Material N), and about 22.1 g aminopropyltriethoxysilane (about 0.1 mol., Aldrich). The temperature is gradually raised to about 90° C. as ethanol distills out of the reaction mix. The heating and stirring is continued for about 6 hours after which the solvent is stripped from the reaction mixture to give the desired silicone having amine and ethoxylate functionality in addition to residual $SiOCH_2CH_3$, hydrolyzable groups.

Alternative Preparation

The above synthesis is repeated without added solvent. The reaction temperature is raised to about 110° C. (instead of about 90° C.) for about 6 hours to give directly a curable silicone with amine and ethoxylate functionality.

Alternative Preparation

The above synthesis without solvent is repeated, but with the addition of about 1 ml of a 10% solution of boron trifluoride in methanol to aid the condensation. In this case, the reaction temperature is raised only to about 90° C. for about 4 hours to give a curable silicone with amine and ethoxylate functionality.

EXAMPLE II

Quaternized Form of Curable Silicone with both Amine and Polyalkyleneoxy Functionality of Example I The synthesis is conducted similarly as in above Example I. The aminofunctional silicone obtained is mixed with about 140 ml of methanol and stirred vigorously at room temperature as about 12.6 g (about 0.1 mol.) of dimethyl sulfate is added dropwise. After about 10 minutes, about 21.6 g (about 0.1 mol.) of about 25% sodium methoxide in methanol (Aldrich) is added dropwise with stirring. An additional amount of about 12.6 g of dimethyl sulfate is added dropwise and after about 10 minutes, another about 21.6 g of about 25% sodium methoxide is added with continued vigorous stirring. Then a final amount of about 21.6 g of dimethyl sulfate is added and stirring is continued for about 30 minutes to give a nearly neutral reaction mixture. The precipitated salt is removed by filtration and the solvent is stripped under vacuum to give the desired curable silicone with quaternized amine, ethoxylate and alkoxysilane functionality.

EXAMPLE III

Preparation of Curable Silicone with Both Amine and Polyethyleneoxy Functionality by Hydrosilation EXAMPLE IIIa With methoxysilane reactive groups.

An amount of about 10.2 g (about 0.02 mol.) of $CH_3(OCH_2CH_2)_nOCH_2CH{=}CH_2$ with average n of about 10, prepared as above (Intermediate Material J1) is dissolved in about 150 ml toluene in a 500 ml round bottom flask equipped with magnetic stirring, short path distillation head and argon blanketing. About 50 ml of toluene is distilled off to dry the system and the resulting solution is cooled to room temperature. The distillation head is replaced by a reflux condenser. Then, a portion of about 62 g of a methyl terminated copolymer of methylhydrosiloxane and dimethylsiloxane with MW of about 62,000 and about 6 mole % hydrosiloxane groups (about 0.001 mole, about 0.05 equivalents SiH, Gelest) is added along with about a 20 $\mu$L portion of platinum-divinyltetramethyldisiloxane complex in xylene (Gelest). The system is heated under reflux for about 2 hours after which a stripped aliquot shows no residual allyl resonance in the proton NMR spectrum in $CDCl_3$. Then, N-allylethylenediamine (about 2.0 g, about 0.02 mol.) prepared as above (Intermediate Material R) is added to the bulk reaction mixture and heating at reflux is continued for about 2 hours, at which time an aliquot shows no remaining allyl resonances by NMR. Then, about 1.32 g (about 0.01 mol.) vinylmethyldimethoxysilane (Gelest) is added and the reaction mixture is heated at about 100° C. for about 8 hours. The solvent is then stripped off to give the desired curable silicone with amino, methyl-capped ethoxylate, and $SiOCH_3$ functionality.

EXAMPLE IIIb

Silicones with Ethoxylated-proproxylated Groups.

The above preparation is repeated except that the ethoxylated intermediate J1 is replaced by an equimolar amount of the ethoxylated analog, intermediate J2. This produces the desired curable silicone with amino, methyl-capped alkoxylate, and $SiOCH_3$ functionality.

EXAMPLE IIIc

Silicones with Ethoxylated-proproxylated Groups.

The above preparation is repeated except that the ethoxylated intermediate J1 is replaced by an equimolar amount of the propoxylated-ethoxylated analog, intermediate J3. This produces the desired curable silicone with amino, methyl-capped alkoxylate, and $SiOCH_3$ functionality.

EXAMPLE IIId

Silicones with Hindered Alcohol Capping Groups.

The preparation is repeated except that the ethoxylated intermediate J1 is replaced by an equimolar amount of the analog capped with a hindered alcohol, J4. This produces the desired curable silicone with amino and $SiOCH_3$ functionality, and $—CH_2C(CH_3)_2(OH)$-capped ethoxylate pendant groups.

EXAMPLE IIIe

Silicones with Tetrahydropyranyl Capping Groups.

The preparation is repeated except that the ethoxylated intermediate J1 is replaced by an equimolar amount of the analog having a tetrahydropyranyl (THP) capping group, Intermediate Material K2. In this case, a few drops of triethylamine is added along with the THP derivative to ensure that the system remains on the alkaline side. This gives the desired curable silicone with amino, THP-capped ethoxylate, and $SiOCH_3$ functionality. This material is further transformed by mixing with methanol and adding enough methanesulfonic acid to make the system very slightly acidic to release the THP groups and give a solution containing the desired curable silicone with amino, uncapped ethoxylate, and $SiOCH_3$ functionality.

EXAMPLE IV

Preparation of Curable Silicone with Both Amine and Polyethyleneoxy Functionality by Hydrosilation, and with Non-terminal, Reactive Si—OCH, Groups on the Silicone Backbone The synthesis of Example III is repeated, except that instead of adding the vinylmethyldimethoxysilane, about 2 g (about 0.06 mol) methanol containing about 12% $BF_3$ (Aldrich) is added and the system is heated at about 60° C. for about 12 hours as hydrogen is evolved. The solvent is then stripped off under vacuum to obtain the desired curable silicone with amino, methyl-capped ethoxylate, and non-terminal, reactive $SiOCH_3$ functionality on the silicone backbone.

EXAMPLE V

Preparation of Curable Silicone with Both Amine and Polyethyleneoxy Functionality by Hydrosilation, with Acetoxysilane Functionality for Increased Moisture Sensitivity An amount of about 10.2 g (about 0.02 mol.) of $CH_3(OCH_2CH_2)_nOCH_2CH{=}CH_2$ with average n of about 10, prepared as above (Intermediate Material J1), is dissolved in about 150 ml toluene in a 500 ml round bottom flask equipped with magnetic stirring, short path distillation head and argon blanketing. About 50 ml of toluene is distilled off to dry the system and the resulting solution is cooled to room temperature. The distillation head is replaced by a reflux condenser. Then, an amount of about 62 g of a methyl terminated copolymer of methylhydrosiloxane and dimethylsiloxane with MW of about 62,000 and about 6 mole % hydrosiloxane groups (about 0.001 mole, about 0.05 equivalents SiH, Gelest) is added along with about 1.9 g (about 0.0046 mol) hexachloroplatinic acid. The system is heated under reflux for about 2 hours after which a stripped aliquot shows no residual allyl resonance in the proton NMR spectrum in $CDCl_3$. Then, dimethylallylamine (about 1.7 g, about 0.02 mol., Across Organics) is added to the bulk reaction mixture and heating is resumed for about 12 hours at about 60° C., at which time an aliquot shows no remaining allyl resonances by NMR. Then, about 1.9 g (about 0.01 mol.) vinylmethyldiacetoxysilane (Gelest) is added and the reaction mixture is heated at about 100° C. for about 8 hours. The solvent is then stripped off to give the desired curable silicone with amino, ethoxylate, and SiOAc functionality.

EXAMPLE VI

Preparation of Curable Silicone with Both Amine and Polyethyleneoxy Functionality by Equilibration of Polysiloxanes EXAMPLE VIa Silicone with Methyl-Capped Polyethyleneoxy Functionality.

A 500 ml round bottom flask is set up with magnetic stirring, argon blanketing, and distillation head. In the flask are placed about 150 ml toluene, about 25.6 g (about 0.04 mol) of the amine-substituted cyclotetrasiloxane, $[Si(O)(CH_3)(CH_2CH_2CH_2NHCH_2CH_2NH_2)]_4$, prepared as above (Intermediate Hydrosilation Material S), about 85.1 g (about 0.04 mol.) of the ethoxylate-substituted cyclotetrasiloxane, $[Si(O)(CH_3)CH_2CH_2CH_2(OCH_2CH_2)_{10}OCH_3]_4$, prepared as above, (Intermediate Hydrosilation Material O) and about 100.8 g (about 0.34 mol.) of octamethylcyclotetrasiloxane (Gelest). The system is taken to the boiling point and about 50 ml of toluene is distilled out to dry the system. Then, about 9 g (about 0.01 mol.) of methoxy terminated polydimethylsiloxane with molecular weight of about 900 (Gelest) is added along with about 0.5 g of tetramethylammonium siloxanolate (Gelest) as a catalyst and the distillation head is replaced with a reflux condenser. Then the reaction mixture is heated to about 95° C. and held there for about 18 hours. Acetic acid about 0.2 g (about 0.03 mol.) is added sufficient to neutralize the strong base and the solvent is stripped on a rotary evaporator to yield the desired curable silicone with amine, ethoxylate, and $SiOCH_3$ functionality.

EXAMPLE VIb

Silicone with Tetrahydropyranyl-Capped Polyethyleneoxy Functionality.

The synthesis is repeated except that the $[Si(O)(CH_3)CH_2CH_2CH_2(OCH_2CH_2)_{10}OCH_3]_4$ is replaced by an equimolar amount of the THP-capped ethoxylate-substituted cyclotetrasiloxane, $[Si(O)(CH_3)CH_2CH_2CH_2(OCH_2CH_2)_{10}O\text{-}THP]_4$, prepared as above (Intermediate Hydrosilation Material P). In this case, acetic acid is not added after the equilibration and the desired curable silicone with amine, ethoxylate, and $SiOCH_3$ functionality also having THP-capped ethoxylate chains is obtained.

EXAMPLE VIc

Silicone with Hydroxyl-Capped Polyethyleneoxy Functionality.

A portion of the silicone with tetrahydropyranyl-capped polyethyleneoxy functionality material prepared as above is taken up in methanol containing enough acetic acid to neutralize the base and provide mild acidity to release the THP protecting group. The resulting reaction mixture is partially stripped under vacuum to remove part of the methanol and yield a solution of the desired curable silicone with amine, hydroxyl-terminated ethoxylate, and $SiOCH_3$ functionality.

EXAMPLE VId

Silicone with Hydroxyl-Capped Polyethyleneoxy Functionality.

The synthesis is repeated again, except that the more highly ethoxylated THP-capped ethoxylate-substituted cyclotetrasiloxane $[Si(O)(CH_3)CH_2CH_2CH_2(OCH_2CH_2)_{24}O\text{-}THP]_4$ (P1) is used to prepare the desired THP-capped curable silicone.

EXAMPLE VIe

A portion of the silicone of Example VId is hydrolyzed as described above, to give the corresponding hydroxyl-terminated silicone.

EXAMPLE VII

Preparation of Curable Silicone with Both Amine and Polyethyleneoxy Functionality by Hydrosilation of Capped, Ethoxylated Allylamine EXAMPLE VIIa Silicone with $SiOCH_3$ Functionality and Methyl-Capped Polyethyleneoxy Functionality.

An amount of about 21 g (about 0.04 mol.) of capped, ethoxylated allylamine, $CH_2{=}CHCH_2N[(CH_2CH_2O)_nCH_3]_2$ with average n of about 5, prepared as above (Intermediate Material G), is dissolved in about 150 ml toluene in a 500 ml round bottom flask equipped with magnetic stirring, short path distillation head and argon blanketing. About 50 ml of toluene is distilled off to dry the system and the resulting solution is cooled to room temperature. The distillation head is replaced by a reflux condenser. Then, a portion of about 62 g of a methyl terminated copolymer of methylhydrosiloxane and dimethylsiloxane with MW of about 62,000 and about 6 mole % hydrosiloxane groups (about 0.001 mole, about 0.05 equivalents SiH, Gelest) is added along with about a 20 $\mu$L portion of platinum-divinyltetramethyldisiloxane complex in xylene (2.4% Pt, Gelest). The system is heated under reflux for about 4 hours after which a stripped aliquot shows no residual allyl resonance in the proton NMR spectrum in $CDCl_3$ Then, about 1.3 g (about 0.01 mol.) vinylmethyldimethoxysilane (Gelest) is added and the reaction mixture is heated at about 100° C. for about 8 hours. The solvent is then stripped off to give the desired curable silicone with ethoxylated amino, and $SiOCH_3$ functionality.

EXAMPLE VIIb

The preparation is repeated, except that the more highly ethoxylated allylamine homolog, $CH_2{=}CHCH_2N[(CH_2CH_2O)_nCH_3]_2$ with average n of about 22 (Intermediate Material G2) is used to give the desired curable silicone having ethoxylated amino and $SiOCH_3$ functionality.

EXAMPLE VIIc

Silicone with SiOCOCH, Functionality.

The preparation of Example VIIb is repeated, except that the vinylmethyldimethoxysilane is replaced by an equimolar amount of vinylmethyldiacetoxysilane. This yields the desired curable silicone with ethoxylated amine and SiOAc functionality.

EXAMPLE VIId

Silicone with $SiOCH_3$ Functionality and Hindered Hydroxyisobutylyl-Capped Polyethyleneoxy Functionality.

The first preparation in this group, Example VIIa, is repeated except that the methyl capped, ethoxylated allylamine derivative is replaced by about 43.2 g (about 0.04 mol.) of the hindered hydroxyisobutyl-capped analog, $CH_2{=}CHCH_2N[(CH_2CH_2O)_n{-}CH_2C(OH)(CH_3)_2]_2$ with average n of about 10 prepared as described above (Intermediate Material H). This yields the desired curable silicone with ethoxylated amino and $SiOCH_3$ functionality and hindered alcohol-capped ethoxylate groups.

EXAMPLE VIII

Preparation of Curable Silicone with Ethoxylated Amino Functionality by Equilibration of Polysiloxanes A 500 ml round bottom flask is set up with mechanical stirring, argon blanketing, and short path distillation head. In the flask are placed about 200 ml toluene, about 93.6 g (about 0.04 mol) of the aminoethoxylate-substituted cyclotetrasiloxane, $[Si(O)(CH_3)CH_2CH_2CH_2N\{(OCH_2CH_2)_5OCH_3\}_2]_4$ prepared as above (Intermediate Hydrosilation Material Q), and about 100.8 g (about 0.34 mol.) octamethylcyclotetrasiloxane (Gelest). The system is taken to the boiling point and about 50 ml of toluene is distilled out to dry the system. Then, about 9 g (about 0.01 mol.) of methoxy terminated polydimethylsiloxane with molecular weight of about 900 (Gelest) is added along with about 0.5 g of tetramethylammonium siloxanolate (Gelest) and the distillation head is replaced with a reflux condenser. Then the reaction mixture is heated to about 95° C. and held there for about 18 hours. Acetic acid about 0.2 g (about 0.03 mol.) is added sufficient to neutralize the strong base and the solvent is stripped on a rotary evaporator to yield the desired curable silicone with ethoxylated amino, and $SiOCH_3$ functionality.

Quaternized Form.

The synthesis is repeated, but rather than adding acetic acid near the end, the reaction mixture is cooled to room temperature and about 5.04 g dimethyl sulfate (about 0.16 mol. Aldrich) is added dropwise with good stirring. Stirring is continued at room temperature for about 3 hours. Then the solvent is stripped under vacuum to give the desired curable silicone with quaternized, ethoxylated amino groups and $SiOCH_3$ functionality.

EXAMPLE IX

Preparation of Curable Silicone with Ethoxylate and Amino Functionality from Vinyl-Terminated and Silane-Terminated Units In a 2000 ml, round bottom flask equipped with mechanical stirring, reflux condenser, and argon blanketing, are placed about 200 ml toluene, about 405 g (about 0.90 mol) hydride-terminated polydimethylsiloxane (Gelest), about 137.5 g (0.50 mol) of the vinyl-terminated oligosiloxane with pendant amino groups,

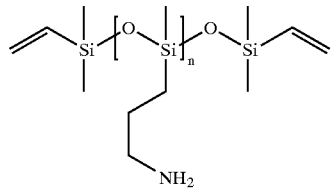

where average n is about 1, prepared as described above (Intermediate Material T), and about 255 g (about 0.50 mol) of the vinyl-terminated oligosiloxane with pendant ethoxylate groups,

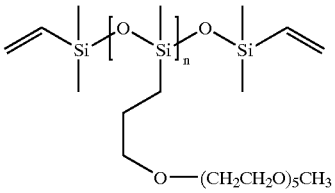

where average n is about 1, prepared as described above (Intermediate Material U). The system is stirred at about 80° C. and about 4.1 g (about 0.01 mol) chloroplatinic acid is added in small portions to avoid an excessive exotherm. After about 6 hours, the temperature was raised to about 100° C. and held there for another about 18 hours. Then the reaction mixture is cooled to about 80° C. and about 33.7 g (about 0.3 mol) trimethoxysilane (Gelest) is added and the system is heated at about 80° C. for about 6 hours and then the internal temperature is raised to about 95° C. and held there for about 18 hours. An aliquot examined by proton NMR indicates that the vinyl functionality has disappeared. The solvent and excess trimethoxysilane are stripped on a rotary evaporator to yield the desired curable silicone with amino, ethoxylate, and terminal, reactive trimethoxysilane functionality.

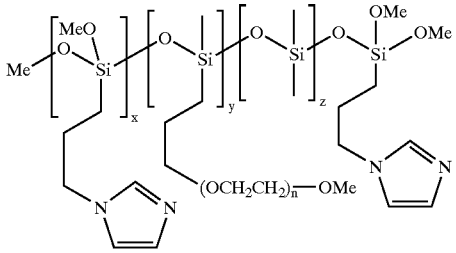

EXAMPLE Xb

Imidazolium Form.

A portion of the imidazole-substituted silicone prepared above is dissolved in methylene chloride and stirred vigorously at room temperature while sufficient dimethyl sulfate to quaternize the imidazole functions is added dropwise. After stirring for about 1 hour, a few drops of imidazole are added to consume any excess alkylating agent and buffer any traces of acid. The solvent is then stripped off on the rotary evaporator to give the desired curable silicone with imidazolium groups, polyethoxylate groups and residual hydrolyzable $SiOCH_3$ groups.

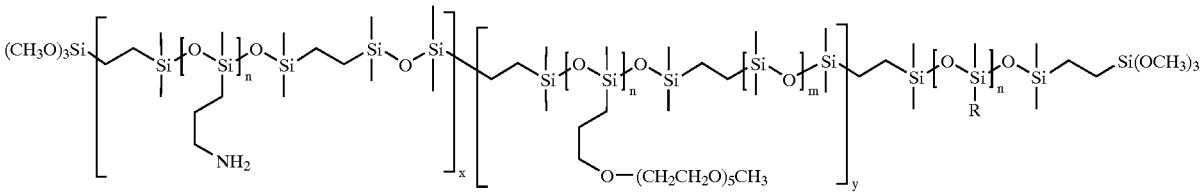

EXAMPLE X

Preparation of Curable Silicone with Both Imidazole (or Imidazolium) and Polyethyleneoxy Functionality by Silanol Condensation EXAMPLE Xa Imidazole Form.

In a 500 ml round bottom flask equipped with mechanical stirring, fractionation column and argon blanketing, are placed about 150 ml toluene, about 80 g silanol terminated polydimethylsiloxane (about 0.2 mol, Gelest, molecular weight of about 400), about 42.6 g (0.1 mol.) of the $CH_3(OCH_2CH_2)_nOCH_2CH_2CH_2Si(CH_3)(OCH_2CH_3)_2$, with average n of about 5 prepared as above (Intermediate Material N1), and about 23 g N-trimethoxysilylpropylimidazole (about 0.1 mol., Pfaltz & Bauer Inc., Waterbury, Conn.). The temperature is gradually raised to about 90° C. as ethanol distills out of the reaction mix. The heating and stirring is continued for about 6 hours after which the solvent is stripped from the reaction mixture to give the desired curable silicone having imidazole and polyethoxylate functionality in addition to residual $SiOCH_3$, hydrolyzable groups.

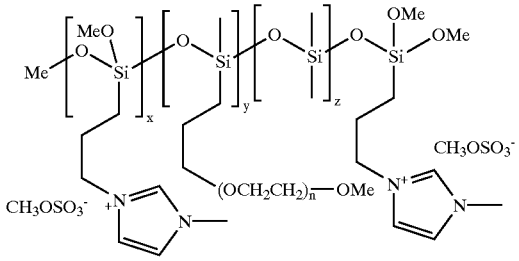

EXAMPLE XI

Preparation of Curable Silicone with Both Imidazole and Polyetheneoxy Functionality by Hydrosilation With methoxysilane reactive groups.

A portion of about 10.2 g (about 0.02 mol.) of $CH_3(OCH_2CH_2)_nOCH_2CH{=}CH_2$ with average n of about 10, prepared as above (Intermediate Material J1), is dissolved in about 150 ml toluene in a 500 ml round bottom flask equipped with magnetic stirring, short path distillation head and argon blanketing. About 50 ml of toluene is distilled off to dry the system and the resulting solution is cooled to room temperature. The distillation head is replaced by a reflux condenser. Then, a portion of about 62 g of a methyl terminated copolymer of methylhydrosiloxane and dimethylsiloxane with MW of about 62,000 and about 6 mole % hydrosiloxane groups (about 0.001 mole, about 0.05 equivalents SiH, Gelest) is added along with an amount of about 40 μL of platinum-divinyltetramethyldisiloxane complex in xylene (Gelest). The system is heated under reflux for about 2 hours after which a stripped aliquot shows no residual allyl resonance in the proton NMR spectrum in $CDCl_3$. Then, allyl chloride (about 1.53 g, about 0.02 mol., Aldrich) is added to the bulk reaction mixture and heating at reflux is continued for about 2 hours, at which time an aliquot shows no remaining allyl resonances by NMR, but some SiH groups remain as indicated by infrared spectroscopy. Then, about 1.48 g (about 0.01 mol.) vinyltrimethoxysilane (Gelest) is added and the reaction mixture is heated at about 100° C. for about 8 hours. NMR spectroscopy indicates that all vinyl groups have disappeared and infrared spectroscopy indicates that only traces of SiH functionality remain. Then, imidazole (about 5 g, about 0.074 mol, Aldrich) is added and the reaction mixture is heated at reflux for about 16 hours. The reaction mixture is cooled to room temperature and sodium methoxide (about 1 g, about 0.19 mol in 25% solution in methanol, Aldrich) is added and after stirring and allowing to stand for about 3 hours, the reaction mixture is filtered. The solvent is then stripped off of the filtrate, first on a rotary evaporator and then on a kugelrohr at 140° C. for about 1 hour to give the desired curable silicone with imidazole, polyethoxylate, and $SiOCH_3$ functionality.

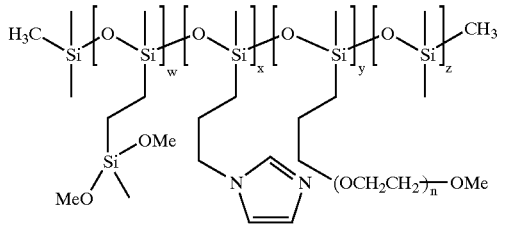

EXAMPLE XII

Preparation of Curable Silicone with Both Imidazole and Polyetheneoxy Functionality by Hydrosilation, with Non-terminal Si—$OCH_3$ Functionality on the Silicone Backbone The synthesis of Example XI is repeated, except that the vinyltrimethoxysilane is not added and after the stripping of solvent and excess imidazole, the hydrosilane-containing polymer is again taken up in about 150 ml of toluene and treated with about 2 g (0.06 mol) methanol containing about 12% $BF_3$ (Aldrich) and the system is heated at about 60° C. for about 12 hours as hydrogen is evolved. The solvent is then stripped off under vacuum to obtain the desired curable silicone with imidazole, ethoxylate, and non-terminal, reactive $SiOCH_3$ functionality on the silicone backbone.

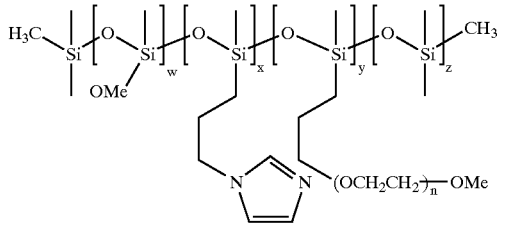

EXAMPLE XIII

Preparation of Curable Silicone with Both Imidazole and Polyetheneoxy Functionality by Hydrosilation, with Acetoxysilane Functionality for Increased Moisture Sensitivity A portion of about 10.2 g (about 0.02 mol.) of $CH_3(OCH_2CH_2)_nOCH_2CH{=}CH_2$ with average n of about 10, prepared as above (Intermediate Material J1), is dissolved in about 150 ml toluene in a 500 ml round bottom flask equipped with magnetic stirring, short path distillation head and argon blanketing. About 50 ml of toluene is distilled off to dry the system and the resulting solution is cooled to room temperature. The distillation head is replaced by a reflux condenser. Then, a portion of about 62 g of a methyl terminated copolymer of methylhydrosiloxane and dimethylsiloxane with Mw of about 62,000 and about 6 mole % hydrosiloxane groups (about 0.001 mole, about 0.05 equivalents SiH, Gelest) is added along with a portion of about 40 μL of platinum-divinyltetramethyldisiloxane complex in xylene (Gelest). The system is heated under reflux for about 2 hours after which a stripped aliquot shows no residual allyl resonance in the proton NMR spectrum in $CDCl_3$. Then, allyl chloride (about 1.53 g, about 0.02 mol, Aldrich) is added to the bulk reaction mixture and heating is resumed for about 12 hours at about 60° C., at which time an aliquot shows only traces of remaining allyl resonances by NMR. Then, imidazole (about 5 g, about 0.074 mol, Aldrich) is added and the reaction mixture is heated at reflux for about 16 hours to displace the chloro groups with imidazole groups. The reaction mixture is cooled to room temperature and sodium methoxide (about 1 g, about 0.019 mol in 25% solution in methanol, Aldrich) is added and after stirring and allowing to stand for about 3 hours, the reaction mixture is filtered. The solvent is then stripped off of the filtrate, first on a rotary evaporator, and then on a kugelrohr at 140° C. for about 1 hour to give an intermediate still containing some hydrosilane functionality. The material is taken up again in about 150 ml of toluene and a fresh portion of about 40 μL of platinum-divinyltetramethyldisiloxane complex in xylene is added. Then, about 1.9 g (about 0.01 mol.) vinylmethyldiacetoxysilane (Gelest) is added and the reaction mixture is heated at about 100° C. for about 8 hours. The solvent is then stripped off to give the desired curable silicone with imidazole, polyethoxylate, and SiOAc functionality.

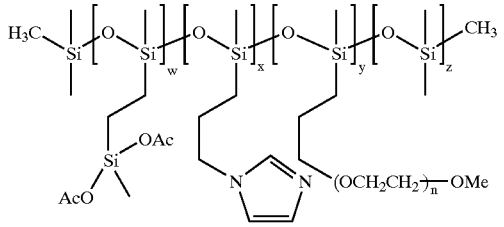

Hydrophilic Non-curable Silicones

Hydrophilic non-curable silicones are also useful for the purpose of the present invention. Following are nonlimiting examples of hydrophilic non-curable silicones suitable for use in the present invention.

EXAMPLE XIV

Preparation of Non-Curable Silicone with Both Amine and Polyethyleneoxy Functionality by Equilibration of Polysiloxanes A 500 ml round bottom flask is set up with magnetic stirring, argon blanketing, and distillation head. In the flask are placed about 200 ml toluene, about 25.6 g (about 0.04 mol) of the amine-substituted cyclotetrasiloxane, $[Si(O)(CH_3)(CH_2CH_2CH_2NHCH_2CH_2NH_2)]_4$, prepared as above (Intermediate Hydrosilation Material S), about 85.1 g (about 0.04 mol.) of the ethoxylate-substituted cyclotetrasiloxane, $[Si(O)(CH_3)CH_2CH_2CH_2(OCH_2CH_2)_{10}OCH_3]_4$, prepared as above (Intermediate Hydrosilation Material O), about 100.8 g (about 0.34 mol.) octamethylcyclotetrasiloxane (Gelest) and about 2.5 g (about 0.01 mol.) 1,3-bis(3-aminopropyl)tetramethyldisiloxane (Gelest). The system is taken to the boiling point and about 50 ml of toluene is distilled out to dry the system. Then, about 1 g of tetramethylammonium siloxanolate (Gelest) is added and the distillation head is replaced with a reflux condenser. The reaction mixture is heated to about 95° C. and held there for about 18 hours. Acetic acid about 0.2 g (about 0.03 mol.) is added sufficient to neutralize the strong base and the solvent is stripped on a rotary evaporator to yield the desired silicone with amino and ethoxylate functionality.

EXAMPLE XV

Preparation of Silicone with Both Imidazole and Polyol Functionality by Hydrosilation Silicone with imidazolylpropyl pendant groups.

A portion of about 10.2 g (about 0.02 mol.) of $CH_3(OCH_2CH_2)_nOCH_2CH{=}CH_2$ with average n of about 10, prepared as above (Intermediate Material J1), is dissolved in about 150 ml toluene in a 500 ml round bottom flask equipped with magnetic stirring, short path distillation head and argon blanketing. About 50 ml of toluene is distilled off to dry the system and the resulting solution is cooled to room temperature. The distillation head is replaced by a reflux condenser. Then, a portion of about 62 g of a methyl terminated copolymer of methylhydrosiloxane and dimethylsiloxane with MW of about 62,000 and about 6 mole % hydrosiloxane groups (about 0.001 mole, about 0.05 equivalents SiH, Gelest) is added along with an amount of about 50 $\mu$L of platinum-divinyltetramethyldisiloxane complex in xylene (Gelest). The system is heated under reflux for about 2 hours after which a stripped aliquot shows no residual allyl resonance in the proton NMR spectrum in $CDCl_3$. Then, allyl chloride (about 2.28 g, about 0.034 mol., Aldrich) is added to the bulk reaction mixture and heating at reflux is continued for about 5 hours, at which time an aliquot shows no remaining remaining SiH bonds by Infrared spectroscopy. Then, imidazole (about 6.8 g, about 0.10 mol, Aldrich) is added and the reaction mixture is heated at reflux for about 16 hours. The reaction mixture is cooled to room temperature and sodium methoxide (about 1.62 g, about 0.03 mol in 25% solution in methanol, Aldrich) is added, and after stirring and allowing to stand for about 3 hours, the reaction mixture is filtered. The solvent is then stripped off of the filtrate, first on a rotary evaporator, and then on a kugelrohr at 140° C. for about 1 hour to give the desired silicone with both polyethoxylate and imidazole functionality.

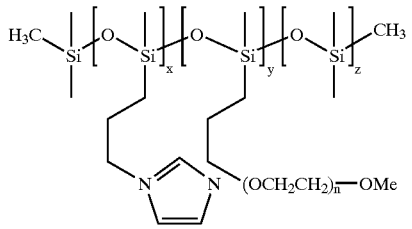

EXAMPLE XVI

Preparation of Silicone with Both Imidazole and Polyol Functionality by Equilibration Polysiloxanes A 500 ml round bottom flask is set up with magnetic stirring, argon blanketing, and distillation head. In the flask are placed about 150 ml toluene, about 8.4 g (about 0.05 equiv.) of the imidazole-substituted oligosiloxanes, $[Si(O)(CH_3)(CH_2CH_2CH_2\text{-Imidazole})]_n$, prepared as above (Intermediate Material V), about 57.6 g (about 0.10 equiv.) of the ethoxylate-substituted cyclotetrasiloxane, $[Si(O)(CH_3)CH_2CH_2CH_2(OCH_2CH_2)_{10}OCH_3]_4$, prepared as above (Intermediate Material O), and about 100.8 g (about 1.36 equiv.) octamethylcyclotetrasiloxane (Gelest). The system is taken to the boiling point and about 50 ml of toluene is distilled out to dry the system. Then, about 1 g of tetramethylammonium siloxanolate (Gelest) is added and the distillation head is replaced with a reflux condenser. The reaction mixture is heated to about 95° C. and held there for about 18 hours. Acetic acid, about 0.2 g (about 0.03 mol.) is added, sufficient to neutralize the strong base and the solvent is stripped on a rotary evaporator to yield the desired silicone with imidazole and polyethoxylate functionality.

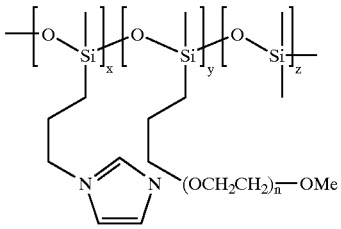

EXAMPLE XVII

Preparation of Silicone with Imidazole-Terminated Ethoxylate Pendant Groups by Hydrosilation A portion of about 33.6 g (0.06 mol.) of imidazole-terminated allyl ethoxylate, $CH_2{=}CHCH_2(OCH_2CH_2)_n$-imidazole, with average n of about 10, prepared as above (Intermediate Material M), is dissolved in about 150 ml toluene in a 500 ml round bottom flask equipped with magnetic stirring, short path distillation head and argon blanketing. About 50 ml of toluene is distilled off to dry the system and the resulting solution is cooled to room temperature. The distillation head is replaced by a reflux condenser. Then, an amount of about 62 g of a methyl terminated copolymer of methylhydrosiloxane and dimethylsiloxane with MW of about 62,000 and about 6 mole % hydrosiloxane groups (about 0.001 mole, about 0.05 equivalents SiH, Gelest) is added along with a portion of about 20 $\mu$L of platinum-divinyltetramethyldisiloxane complex in xylene (Gelest). The reaction mixture is then heated at reflux for about 18 hours. At this point, infrared spectroscopy indicates that essentially all the SiH functionality has been consumed. The solvent is removed by stripping on a rotary evaporator to give the desired silicone with imidazole-capped ethoxylate groups along with a small residual amount of unreacted starting imidazole-capped allyl ethoxylate.

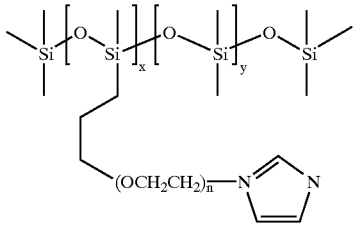

EXAMPLE XVIII

Preparation of Ethoxylated Silicone with Silicone Blocks, Polyethoxylate Blocks, and Imidazolium Groups in the Main Chain An amount of about 66.6 g (about 0.1 mol) of imidazole-terminated silicone (Intermediate Material W) is placed in a 500 ml, round bottom flask with about 47.3 g (about 0.09 mol, Aldrich) of polyethylene glycol, diglycidyl ether of molecular weight 526 and about 10.8 g (about 0.18 mol) acetic acid. The reaction mixture is stirred vigorously with a mechanical stirrer and is heated to about 90° C. and held there about 18 hours. This produces the desired silicone containing both polyethoxylate and imidazolium groups in the chain.

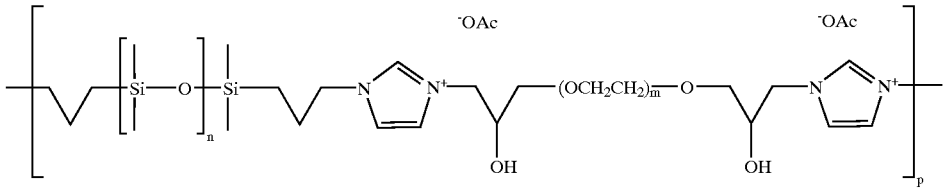

where n is about 5 and m is about 9.

For fabric color restoration and/or rejuvenation, the compositions comprising cationic and/or curable silicone polymers can be applied to fabrics via a, e.g., dipping, soaking, misting and/or spraying process, followed by a drying step. The application can be done commercially by large scale processes, or in a consumer's home by the use of a consumer product. Special care needs to be taken when a composition of this invention is to be dispensed from a spray dispenser in a consumer household setting, because if a portion of the composition that is sprayed misses the garment, and falls instead on floor surfaces, such as rugs, carpet, concrete, tile, linoleum, or other surfaces such as the bathtub, the composition can leave a silicone layer that may cured and/or bond to such surfaces. Silicones that bond to surfaces are difficult to remove. Flooring surfaces may become slippery and can present a safety hazard to the household members. For a fabric care consumer spray product, it is desirable that the spraying and/or misting of the entire garment occurs in a manner such that excessive amounts of the fabric/garment care composition are prevented from being released to the open environment. For example, the spraying and/or misting of the entire garment is done in an enclosed and/or containable space, such as within a bag. The composition can also be applied via spraying and/or misting from a dispensing device adaptable to articles suitable for containing the garment, such as an automatic clothes dryer or a cabinet. When such care is taken, the curable and/or reactive silicones are preferred in the compositions of the present invention to provide a longer lasting color restoration and rejuvenation benefit, that is, the benefit remains after at least one washing cycle.

The curable silicone polymers can be formulated as aqueous compositions, such as solutions, dispersions, and/or emulsions. However, since the curable silicone polymers have reactive functional groups that can condense to form Si—O—Si bonds in the presence of moisture, it is preferred to formulate said silicone polymers in anhydrous compositions for long term stability. Said liquid compositions can comprise liquid carrier such as anhydrous solvents that do not promote crosslinking, such as low molecular weight monohydric alcohols, e.g., ethanol, methanol, isopropanol, and mixtures thereof. When a dilute aqueous composition is desirable, it is best to first prepare a concentrated composition containing the desired curable silicone in a suitable anhydrous solvent which is miscible with water, such as anhydrous low molecular weight alcohols, e.g., ethanol, methanol, isopropanol, and mixtures thereof, such a concentrated composition is then diluted with water immediately prior to application to the target surface, and then let dry and cure on the surface. Because of this complex procedure, it is preferred to provide the hydrophilic curable silicone polymers of the present invention to the consumer in the form of an article of manufacture comprising an anhydrous composition in association with instructions for use to direct the consumer to properly apply an effective amount of hydrophilic curable silicone polymer to the surface to provide the desired benefits.

Ethoxylated Polyamines

Nonlimiting examples of ethoxylated polyamines and/or ethoxylated amine polymers, including ethoxylated polyalkyleneamines and ethoxylated polyalkyleneimines that are useful in the present invention are given in U.S. Pat. No. 4,597,898, issued Jul. 1, 1986 to Vander Meer, said patent is incorporated herein by reference. This patent discloses preferred water soluble ethoxylated polyamines and ethoxylated amine polymers for clay soil removal and anti-redeposition benefits, preferably having long polyethoxylate pendant groups, preferably each pendant group with at least about 6 ethyleneoxy units, and more preferred in the range of from about 12 to about 42 ethyleneoxy units. The preferred polyethoxylated pendant groups of the present invention are shorter, preferably less than about 6 more preferably less than about 4 ethyleneoxy units for each pendant group, to improve fabric substantivity.

Other Cationic Synthetic Polymers

Water soluble and water dispersible synthetic polymers useful in the present invention comprise cationic monomers, in addition to nonionic monomers. Some nonlimiting examples of cationic monomers that can be used to form the synthetic polymers of the present invention include: unsaturated amines, such as vinyl amine, diethylene triamine, dimethylaminoethyl methacrylate; salts thereof; alkyl quaternized derivatives thereof; polar vinyl heterocyclics, such as vinyl pyrrolidone, vinyl caprolactam, vinyl pyridine, vinyl imidazole, and mixtures thereof; and mixtures thereof. Some nonlimiting examples of nonionic monomers that can be used to form the synthetic polymers of the present invention include:esters and/or half esters of $C_1$–$C_{12}$ alcohols with low molecular weight $C_1$–$C_6$ unsaturated organic mono-carboxylic and polycarboxylic acids. Examples of such alcohols are methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-lodecanol, and the like, and mixtures thereof. Examples of such acids are acrylic acid, methacrylic acid, crotonic acid, maleic acid and its half esters, itaconic acid, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof. Examples of other suitable monomers includes; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), allyl alcohol; esters of said alcohols with low molecular weight carboxylic acids, such as, vinyl acetate, vinyl propionate; ethers of said alcohols such as methyl vinyl ether; aromatic vinyl such as styrene, alpha-methylstyrene, t-butylstyrene, vinyl toluene, and the like; low molecular weight unsaturated hydrocarbons and derivatives such as ethylene, propylene, butadiene, cyclohexadiene, vinyl chloride; vinylidene chloride; and mixtures thereof.

Preferably, said monomers form homopolymers and/or copolymers that are water soluble or water dispersible in water and have a molecular weight of at least about 500, preferably from about 1,000 to about 2,000,000, more preferably from about 4,000 to about 1,000,000, and even more preferably from about 10,000 to about 300,000 for some polymers.

Polymers useful in the present invention can comprise homopolymers and copolymers of hydrophilic monomers and hydrophobic monomers. The copolymer can be linear random or block copolymers, and mixtures thereof. The hydrophobic/hydrophilic copolymers typically have a hydrophobic monomer/hydrophilic monomer ratio of from about 10:90 to about 90:10, preferably from about 20:80 to about 80:20, more preferably from about 30:70 to about 75:25, by weight of the copolymer. The hydrophobic monomer can comprise a single hydrophobic monomer or a mixture of hydrophobic monomers, and the hydrophilic monomer can comprise a single hydrophilic monomer or a mixture of hydrophilic monomers. The term "hydrophobic" is used herein consistent with its standard meaning of lacking affinity for water, whereas "hydrophilic" is used herein consistent with its standard meaning of having affinity for water. As used herein in relation to monomer units and polymeric materials, including the copolymers, "hydrophobic" means substantially water insoluble; "hydrophilic" means substantially water soluble. In this regard, "substantially water insoluble" shall refer to a material that is not soluble in distilled (or equivalent) water, at 25° C., at a concentration of about 0.2% by weight, and preferably not soluble at about 0.1% by weight (calculated on a water plus monomer or polymer weight basis). "Substantially water soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, corresponds to the maximum concentration of monomer or polymer, as applicable, that can dissolve in water or other solvents to form a homogeneous solution, as is well understood to those skilled in the art.

Nonlimiting examples of useful hydrophilic monomers are unsaturated organic mono-carboxylic and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as vinyl pyrrolidone, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, vinyl pyrrolidone, salts thereof and alkyl quaternized derivatives thereof, and mixtures thereof.

Nonlimiting examples of useful hydrophobic monomers are acrylic acid $C_1$–$C_{18}$ alkyl esters, such as methyl acrylate, ethyl acrylate, t-butyl acrylate; methacrylic $C_1$–$C_{18}$ alkyl esters, such as methyl methacrylate, 2-ethyl hexyl methacrylate, methoxy ethyl methacrylate; vinyl alcohol esters of carboxylic acids, such as, vinyl acetate, vinyl propionate, vinyl neodecanoate; aromatic vinyls, such as styrene, t-butyl styrene, vinyl toluene; vinyl ethers, such as methyl vinyl ether; vinyl chloride; vinylidene chloride; ethylene, propylene and other unsaturated hydrocarbons; and the like; and mixtures thereof. Some preferred hydrophobic monomers are methyl acrylate, methyl methacrylate, t-butyl acrylate, t-butyl methacrylate, n-butyl acrylate, n-butyl methacrylate, and mixtures thereof.

Some non-limiting examples of water soluble and water dispersible homopolymers include polyacrylic acid, polyacrylamide; polymethacrylic acid; polymethacrylamide; polyvinyl alcohol; polyvinyl acetate; polyvinylpyrrolidone; polyvinyloxazolidone; polyvinylmethyloxazolidone; polyethylene oxide; polypropylene oxide; polyvinylpyridine n-oxide; polyquaternary amine resins; poly (ethenylformamide); poly(vinylamine)hydrochloride; and mixtures thereof. Many of these polymers are described with more details in "Water-Soluble Synthetic Polymers: Properties and Behavior, Volume I, Philip Molyneux, published by CRC Press, 1983, incorporated herein by reference. Preferably said homopolymers are selected from the group consisting of polyvinyl alcohol; polyvinyl acetate; polyacrylic acid; polyacrylamide; polymethacrylic acid; polymethacrylamide; polyvinylpyrrolidone; polyvinyloxazolidone; polyethylene oxide; polypropylene oxide; polyvinylpyridine n-oxide; and mixtures thereof.

Some non-limiting examples of copolymers which can be used as fabric color care active of the present invention are: adipic acid/dimethylaminohydroxypropyl diethylenetriamine copolymer; adipic acid/epoxypropyl diethylenetriamine copolymer; poly(vinylpyrrolidone/dimethylaminoethyl methacrylate); methacryloyl ethyl betaine/methacrylates copolymer, ethyl acrylate/methyl methacrylate/methacrylic acid/acrylic acid copolymer; poly (vinyl alcohol-co-6% vinylamine); poly(vinyl alcohol-co-12% vinyl amine); poly(vinyl alcohol-co-6% vinylamine hydrochloride); and poly(vinyl alcohol-co-12% vinylamine hydrochloride). Preferably, said copolymer are selected from the group consisting of adipic acid/dimethylaminohydroxypropyl diethylenetriamine copolymer; poly(vinylpyrrolidone/dimethylaminoethyl methacrylate); ethyl acrylate/methyl methacrylate/methacrylic acid/acrylic acid copolymer; methacryloyl ethyl betaine/methacrylates copolymer, polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co6% vinylamine hydrochloride); and poly(vinyl alcohol-co-12% vinylamine hydrochloride).

Nonlimiting examples of the preferred polymer that are commercially available are: polyvinylpyrrolidone/dimethylaminoethyl methacrylate copolymer, such as Copolymer 958®, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019®, available from Air Products and Chemicals or Moweol®, available from Clariant; adipic acid/epoxypropyl diethylenetriamine copolymer, such as Delsette 101®, available from Hercules Incorporated; and polyvinylpyrrolidone/acrylic acid, such as Sokalan EG 310®, available from BASF.

Non limiting examples of polymers for use in the present invention include the following, where the composition of the copolymer is given as approximate weight percentage of each monomer used in the polymerization reaction used to prepare the polymer: vinyl pyrrolidone/vinyl acetate copolymers (at ratios of up to about 30% by weight of vinyl pyrrolidone); dimethyl acrylamide/t-butyl acrylate/ethyl hexyl methacrylate copolymer (10/45/45); vinyl pyrrolidone/vinyl acetate/butyl acrylate copolymer (10/78/12 and 10/70/20); vinyl pyrrolidone/vinyl propionate copolymer (5/95); vinyl caprolactam/vinyl acetate copolymer (5/95); acrylic acid/t-butyl acrylate (25/75) and styling resins sold under the trade names Ultrahold CA 8® by Ciba Geigy (ethyl acrylate/acrylic acid/N-t-butyl acrylamide copolymer); Resyn 28-1310® by National Starch and Luviset CA 66® by BASF (vinyl acetate/crotonic acid copolymer 90/10); Luviset CAP® by BASF (vinyl acetate/vinyl propionate/crotonic acid 50/40/10); Resyn 28-2930® by National Starch (vinyl acetate/vinyl neodecanoate/crotonic acid copolymer), Amerhold DR-25® by Union Carbide (ethyl acrylate/methacrylic acid/methyl methacrylate/acrylic acid copolymer), and Poligen A® by BASF (polyacrylate dispersion).

A preferred fabric color care active comprises copolymers containing hydrophobic monomers and hydrophilic monomers which comprise unsaturated organic mono-carboxylic and polycarboxylic acid monomers, such as acrylic acid, methacrylic acid, crotonic acid, maleic acid and its half esters, itaconic acid, and salts thereof, and mixtures thereof; and optionally other hydrophilic monomers. Examples of the hydrophilic unsaturated organic mono-carboxylic and polycarboxylic acid monomers are acrylic acid, methacrylic acid, crotonic acid, maleic acid and its half esters, itaconic acid, and mixtures thereof. Nonlimiting examples of the hydrophobic monomers are esters of the unsaturated organic mono-carboxylic and polycarboxylic acids cited hereinabove with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, and mixtures thereof, preferably methanol, ethanol, 1-propanol, 2-propanol, 1-butanol, 2-methyl-1-propanol, t-butanol, and mixtures thereof. One preferred copolymer contains acrylic acid and t-butyl acrylate monomeric units, preferably with acrylic acid/t-butyl acrylate ratios of from about 90:10 to about 10:90, preferably from about 70:30 to about 15:85, more preferably from about 40:60 to about 20:80. Nonlimiting examples of acrylic acid/tert-butyl acrylate copolymers useful in the present invention are those typically with a molecular weight of from about 1,000 to about 2,000,000, preferably from about 5,000 to about 1,000,000, and more preferably from about 30,000 to about 300,000, and with an approximate acrylic acid/tert-butyl acrylate weight ratio of about 25:75 and an average molecular weight of from about 70,000 to about 100,000, and those with an approximate acrylic acid/tert-butyl acrylate weight ratio of about 35:65 and an average molecular weight of from about 60,000 to about 90,000.

A class of water-soluble polymers containing nitrogen and oxygen atoms useful in the present invention for fabric color restoration/rejuvenation can also be used as dye transfer inhibiting agents. These polymers have the ability to complex or adsorb the fugitive dyes washed out of dyed fabrics before the dyes have the opportunity to become attached to other articles in the wash or the rinse. Nonlimiting examples of these actives are polyvinylpyrrolidone polymers, poly(4-vinylpyridine-N-oxide), polyamine N-oxide polymers, copolymers of N-vinylpyrrolidone and N-vinylimidazole, polyvinyloxazolidones and polyvinylimidazoles or mixtures thereof. Examples of such dye transfer inhibiting agents are disclosed in U.S. Pat. No. 5,804,219, issued Sep. 8, 1998 to T. Trinh, S. L.-L. Sung, H. B. Tordil, and P. A. Wendland, and in U.S. Pat. Nos. 5,707,950 and 5,707,951, all are incorporated herein by reference.

Cationic Polyalkyleneterephthlate Copolymers

Another enduring fabric color care active suitable in the present invention comprises block copolymers of polyalkylene terephthalate and polyoxyethylene terephthalate, and block copolymers of polyethylene glycol and polyalkylene terephthalate blocks having cationic groups. The polyalkylene terephthalate blocks preferably comprise ethylene and/or propylene groups. Suitable cationic polymers are described in U.S. Pat. No. 4,956,447, Gosselink, Hardy, and Trinh, issued Sep. 11, 1990, incorporated herein by reference.

The above polyalkylene terephthalate copolymers can be used in the composition of the present invention to additionally provide a soil release benefit.

Optional Silicones

Another preferred fabric color care active comprises silicones and their derivatives. Nonlimiting examples of useful silicones in the composition of the present invention include noncurable silicones such as polydimethylsilicone, and curable silicones such as aminosilicones, phenylsilicones and hydroxysilicones. The word "silicone" as used herein preferably refers to emulsified silicones, including those that are commercially available and those that are emulsified in the composition, unless otherwise described.

The silicones that are preferred in the composition of the present invention is polyalkyl and/or phenyl silicone fluids and gums with the following structure:

$$R—Si(R_2)—O—[Si(R_2)—O—]_q—Si(R_2)—R$$

The R groups substituted on the siloxane chain or at the ends of the siloxane chains can have any structure as long as the resulting silicones remain fluid at room temperature.

Each R group preferably can be alkyl, aryl, and mixtures thereof, more preferably, each R is methyl, ethyl, propyl or phenyl group, most preferably R is methyl, q is preferably an integer from about 7 to about 8,000. The preferred silicones are polydimethyl siloxanes; more preferred silicones are polydimethyl siloxanes having a viscosity of from about 50 to about 5,000 centistokes at 25° C. Suitable examples include silicones offered by Dow Corning Corporation and General Electric Company.

Other useful silicone materials, but less preferred than polydimethyl siloxanes, for general application, include materials of the formula:

A preferred class of optional silicone derivatives that are useful in the present invention are the silicone copolyols. Nonlimiting examples of silicone copolyols are the polyalkylene oxide polysiloxanes having a dimethyl polysiloxane hydrophobic moiety and one or more hydrophilic polyalkylene side chains, and having the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) group having the general formula:

$$—(CH_2)_nO(C_2H_4O)_c(C_3H_6O)_dR^2$$

with at least one $R^1$ being a poly(ethyleneoxy/propyleneoxy) group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Each polyalkylene oxide polysiloxane has at least one $R^1$ group being a poly(ethyleneoxide/propyleneoxide) group.

Nonlimiting examples of this type of silicone copolyols are the Silwet® surfactants available from Witco Corporation. Representative Silwet surfactants that contain only ethyleneoxy ($C_2H_4O$) groups are as follows.

| Name | Average MW | Average a + b | Average total c |
|---|---|---|---|
| L-7607 | 1,000 | 2 | 17 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |
| L-7622 | 10,000 | 88 | 75 |

Nonlimiting examples of surfactants which contain both ethyleneoxy ($C_2H_4O$) and propyleneoxy ($C_3H_6O$) groups are as follows.

| Name | Average MW | EO/PO ratio |
|---|---|---|
| Silwet L-720 | 12,000 | 50/50 |
| Silwet L-7001 | 20,000 | 40/60 |
| Silwet L-7002 | 8,000 | 50/50 |

-continued

| Name | Average MW | EO/PO ratio |
|---|---|---|
| Silwet L-7210 | 13,000 | 20/80 |
| Silwet L-7200 | 19,000 | 75/25 |
| Silwet L-7220 | 17,000 | 20/80 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units (—$C_2H_4O$) in the polyether chain ($R^1$) must be sufficient to render the polyalkylene oxide polysiloxane water dispersible or water soluble. If propyleneoxy groups are present in the polyalkylenoxy chain, they can be distributed randomly in the chain or exist as blocks. Surfactants which contain only propyleneoxy groups without ethyleneoxy groups are not preferred.

A special type of synthetic fabric color care polymer useful in the present invention comprises graft and block copolymers of silicone with moieties containing hydrophilic and/or hydrophobic monomers described hereinbefore. The silicone-containing copolymers in the spray composition of the present invention provide color rejuvenation, and in addition, other fabric care benefits such as shape retention, body, and/or good, soft fabric feel. Preferred silicone-containing copolymers contain hydrophobic monomers and hydrophilic monomers which comprise unsaturated organic mono-carboxylic and/or polycarboxylic acid monomers, such as acrylic acid, methacrylic acid, crotonic acid, maleic acid and its half esters, itaconic acid; and salts thereof; and mixtures thereof; and optionally other hydrophilic monomers.

Optional Ingredients

The fabric care composition of the present invention can optionally contain surfactant, perfume, brightener, odor-controlling agent, antimicrobial active and/or preservative, antistatic agent, antioxidant, insect and moth repelling agent, and mixtures thereof. The total level of optional ingredients is low, preferably less than about 5%, more preferably less than about 3%, and even more preferably less than about 2%, by weight of the usage composition. These optional ingredients exclude the other ingredients specifically mentioned hereinbefore. The optional ingredients need to be compatible with the fabric color care actives that are present in the color care compositions of the present invention.

Surfactant

Surfactant is an optional but highly preferred ingredient of the present invention. Surfactant is especially useful in the composition to facilitate the dispersion and/or solubilization of color improvement agents such as silicones, and/or perfume. Such surfactant is preferably included when the composition is used in a spray dispenser in order to enhance the spray characteristics of the composition and allow the composition, including the fabric color care active, to distribute more evenly, and to prevent clogging of the spray apparatus. The spreading of the composition can also allow it to dry faster, so that the treated material is ready to use sooner. For concentrated compositions, the surfactant facilitates the dispersion of many actives such as silicones, antimicrobial actives, and perfume in the concentrated aqueous compositions. Suitable surfactant useful in the present invention is nonionic surfactant, anionic surfactant, cationic surfactant, amphoteric surfactant, and mixtures thereof. Preferred surfactants for use as emulsifiers for the silicones of the present invention are selected from nonionic surfactants, cationic surfactants, and mixtures thereof.

When surfactant is used in the composition of the present invention, it is added at an effective amount to provide one, or more of the benefits described herein, typically from about 0.01% to about 5%, preferably from about 0.05% to about 3%, more preferably from about 0.1% to about 2%, and even more preferably, from about 0.2% to about 1%, by weight of the usage composition.

A preferred type of surfactant is ethoxylated surfactant, such as addition products of ethylene oxide with fatty alcohols, fatty acids, fatty amines, etc. Optionally, addition products of mixtures of ethylene oxide and propylene oxide with fatty alcohols, fatty acids, fatty amines can be used. Suitable ethoxylated surfactants for use in the compositions, articles, and method of present invention are described PCT Publication No. WO 99/55953, published Nov. 4, 1999 to Trinh et al., said publication being incorporated herein by reference.

Also preferred is a nonionic surfactant selected from the group consisting of fatty acid ($C_{12-18}$) esters of ethoxylated ($EO_{5-100}$) sorbitans. More preferably, said surfactant is selected from the group consisting of mixtures of laurate esters of sorbitol and sorbitol anhydrides; mixtures of stearate esters of sorbitol and sorbitol anhydrides; and mixtures of oleate esters of sorbitol and sorbitol anhydrides. Even more preferably, said surfactant is selected from the group consisting of Polysorbate 20, which is a mixture of laurate esters of sorbitol and sorbitol anhydrides consisting predominantly of the monoester, condensed wvith about 20 moles of ethylene oxide; Polysorbate 60 which is a mixture of stearate esters of sorbitol and sorbitol anhydride, consisting predominantly of the monoester, condensed with about 20 moles of ethylene oxide; Polysorbate 80 which is a mixture of oleate esters of sorbitol and sorbitol anhydrides, consisting predominantly of the monoester, condensed with about 20 moles of ethylene oxide; and mixtures thereof. Most preferably, said surfactant is Polysorbate 60.

Also suitable nonionic ethoxylated surfactants for use herein are alkylpolysaccharides which are disclosed in U.S. Pat. No. 4,565,647, Llenado, issued Jan. 21, 1986, incorporated herein by reference, having a hydrophobic group containing from about 8 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. The intersaccharide bonds can be, e.g., between the one position of the additional saccharide units and the 2-, 3-, 4-, and/or 6-positions on the preceding saccharide units. The preferred alkylpolyglycosides have the formula $$R^2\,O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

Cationic surfactants useful in compositions of the present invention contain amino or quaternary ammonium hydrophilic moieties which are positively charged when dissolved in the aqueous composition of the present invention. Cationic surfactants among those useful herein are disclosed in the following documents, all incorporated by reference herein: M. C. Publishing Co., McCutcheon's, Detergents & Emulsifiers, (North American edition 1979); Schwartz, et al., Surface Active Agents, Their Chemistry and Technology, New York: Interscience Publishers, 1949; U.S. Pat No. 3,155,591, Hilfer, issued Nov. 3, 1964; U.S. Pat No. 3,929,678, Laughlin, et al., issued Dec. 30, 1975; U.S. Pat. No. 3,959,461, Bailey, et al., issued May 25, 1976; and U.S. Pat. No. 4,387,090, Bolich, Jr., issued Jun. 7, 1983.

Among the quaternary ammonium-containing cationic surfactant materials useful herein are those of the general formula:

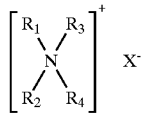

wherein $R_1$ is an aliphatic group of from 1 to 22 carbon atoms, or an aromatic, aryl or alkylaryl group having from 12 to 22 carbon atoms; $R_2$ is an aliphatic group having from 1 to 22 carbon atoms; $R_3$ and $R_4$ are each alkyl groups having from 1 to 3 carbon atoms, and X is an anion selected from halogen, acetate, phosphate, nitrate and alkylsulfate radicals. The aliphatic groups may contain, in addition to carbon and hydrogen atoms, ether linkages, and other groups such as amido groups. Other quaternary ammonium salts useful herein are diquaternary ammonium salts.

Salts of primary, secondary and tertiary fatty amines are also suitable cationic surfactants for use herein. The alkyl groups of such amines preferably have from 12 to 22 carbon atoms, and may be substituted or unsubstituted. Secondary and tertiary amines are preferred, tertiary amines are particularly preferred. Such amines, useful herein, include stearamido propyl dimethyl amine, diethyl amino ethyl stearamide, dimethyl stearamine, dimethyl soyamine, soyamine, myristyl amine, tridecyl amine, ethyl stearylamine, N-tallowpropane diamine, ethoxylated (5 EO units) stearylamine, dihydroxy ethyl stearylamine, and arachidyl-behenylamine. Cationic amine surfactants included among those useful in the present invention are disclosed in U.S. Pat. No. 4,275,055, Nachtigal, et al., issued Jun. 23, 1981, this patent is incorporated herein by reference.

Suitable cationic surfactant salts include the halogen, acetate, phosphate, nitrate, citrate, lactate and alkyl sulfate salts.

Odor Control Agent

The agents for odor control are of the type disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Fabric care compositions of the present invention can contain several different optional odor control agents, preferably cyclodextrins, water soluble zinc salts, water soluble copper salts, and mixtures thereof.

(a). Cyclodextrin

Suitable cyclodextrin for use in the compositions, articles, and method of present invention is described in WO 99/55953 published Nov. 4, 1999 to Trinh et al., said publication being incorporated herein by reference.

For controlling odor on fabrics, the composition is preferably used as a spray. It is preferable that the usage compositions of the present invention contain low levels of cyclodextrin so that a visible stain does not appear on the fabric at normal usage levels. Preferably, the solution used to treat the surface under usage conditions is virtually not discernible when dry. Typical levels of cyclodextrin in usage compositions for usage conditions are from about 0.01% to about 5%, preferably from about 0.1% to about 4%, more preferably from about 0.5% to about 2% by weight of the composition. Compositions with higher concentrations can leave unacceptable visible stains on fabrics as the solution evaporates off of the fabric. This is especially a problem on thin, colored, synthetic fabrics. In order to avoid or minimize the occurrence of fabric staining, it is preferable that the fabric be treated at a level of less than about 5 mg of cyclodextrin per gram of fabric, more preferably less than about 2 mg of cyclodextrin per gram of fabric. The presence of the surfactant can improve appearance by minimizing localized spotting.

When the optional cyclodextrin is present in the composition, the polymer active in the composition of the present invention should be cyclodextrin-compatible, that is it should not substantially form complexes with cyclodextrin so as to diminish performance of the cyclodextrin and/or the polymer. Complex formation affects both the ability of the cyclodextrin to absorb odors and the ability of the polymer to impart color renewal and/or shape retention to fabric. In this case, the monomers having pendant groups that can complex with cyclodextrin are not preferred because they can form complexes with cyclodextrin. Examples of such monomers are acrylic or methacrylic acid esters of $C_7$–$C_{18}$ alcohols, such as neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, and 1-decanol; aromatic vinyls, such as styrene; t-butylstyrene; vinyl toluene; and the like.

(b). Metal Salts

Optionally, but highly preferred, the present invention can include metallic salts for added odor absorption and/or antimicrobial benefit for the cyclodextrin solution when cyclodextrin is present. The metallic salts are selected from the group consisting of copper salts, zinc salts, and mixtures thereof. Suitable metal salts for use in the compositions, articles, and method of present invention are described in WO 99/55953 published Nov. 4, 1999 to Trinh et al., said publication being incorporated herein by reference.

When metallic salts are added to the composition of the present invention they are typically present at a level of from about 0.1% to about 10%, preferably from about 0.2% to about 8%, more preferably from about 0.3% to about 5% by weight of the usage composition. When zinc salts are used as the metallic salt, and a clear solution is desired, it is preferable that the pH of the solution is adjusted to less than about 7, more preferably less than about 6, most preferably, less than about 5, in order to keep the solution clear.

(c). Soluble Carbonate and/or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are added to the composition of the present invention, they are typically present at a level of from about 0.1% to about 5%, preferably from about 0.2% to about 3%, more preferably from about 0.3% to about 2%, by weight of the composition. When these salts are added to the composition of the present invention it is preferably that incompatible metal salts not be present in the invention. Preferably, when these salts are used the composition should be essentially free of zinc and other incompatible metal ions, e.g., Ca, Fe, Ba, etc. which form water-insoluble salts.

(d). Mixtures Thereof

Mixtures of the above materials are desirable, especially when the mixture provides control over a broader range of odors.

Perfume

The composition of the present invention can also optionally provide a "scent signal" in the form of a pleasant odor which provides a freshness impression to the treated fabrics. The scent signal can be designed to provide a fleeting perfume scent. When perfume is added as a scent signal, it is added only at very low levels, e.g., from about 0.001% to about 0.5%, preferably from about 0.003% to about 0.3%, more preferably from about 0.005% to about 0.2%, by weight of the usage composition.

Perfume can also be added as a more intense odor in product and on fabrics. When stronger levels of perfume are preferred, relatively higher levels of perfume can be added.

Any type of perfume can be incorporated into the composition of the present invention. The preferred perfume ingredients are those suitable for use to apply on fabrics and garments. Typical examples of such preferred ingredients are given in U.S. Pat. No. 5,445,747, issued Aug. 29, 1995 to Kvietok et al., incorporated herein by reference.

When long lasting fragrance odor on fabrics is desired, it is preferred to use at least an effective amount of perfume ingredients which have a boiling point of about 240° C. or higher, preferably of about 250° C. or higher. Nonlimiting examples of such preferred ingredients are given in U.S. Pat. No. 5,500,138, issued Mar. 19, 1996 to Bacon et al., incorporated herein by reference. It is also preferred to use materials that can slowly release perfume ingredients after the fabric is treated by the color improvement composition of this invention. Examples of materials of this type are given in U.S. Pat. No. 5,531,910, Severns et al., issued Jul. 2, 1996, said patent being incorporated herein by reference.

When cyclodextrin is present, it is essential that the perfume be added at a level wherein even if all of the perfume in the composition were to complex with the cyclodextrin molecules when cyclodextrin is present, there will still be an effective level of uncomplexed cyclodextrin molecules present in the solution to provide adequate odor control. The selection, and suitable levels of such perfume for use in the compositions, articles, and method of present invention is described in WO 99/55953 published Nov. 4, 1999 to Trinh et al., said publication and description being incorporated herein by reference.

Antimicrobial Active

Optionally, the color improvement composition of the present invention comprise an effective amount, to kill, or reduce the growth of microbes, of antimicrobial active; preferably from about 0.001% to about 2%, more preferably from about 0.002% to about 1%, even more preferably from about 0.003% to about 0.3%, by weight of the usage composition. The effective antimicrobial active can function as disinfectants/sanitizers, and is useful in providing protection against organisms that become attached to the fabrics. Nonlimiting examples of antimicrobial actives which are useful in the present invention are provided in WO 99/55953, published Nov. 4, 1999 to Trini et al., said publication being incorporated herein by reference.

Antimicrobial Preservative

Optionally, but preferably, an antimicrobial preservative can be added to the composition of the present invention, to protect the fabric color care active and/or other easily degradable organic ingredients such as natural polysaccharides. Suitable antimicrobial preservative for use in the compositions, articles, and method of present invention are described in WO 99/55953, published Nov. 4, 1999 to Trinh et al., said publication being incorporated herein by reference. This reference also describes other optional ingredients that can be used in the present invention, e.g., antistatic agent, insect and moth repelling agent, anti-clooging agent, and the like.

Liquid Carrier

The preferred liquid carrier of the present invention is water and/or low molecular weight monohydric alcohols.

The water which is used can be distilled, deionized, or tap water. Water is the main liquid carrier due to its low cost, availability, safety, and environmental compatibility. Water serves as the liquid carrier for the fabric color care active and other soluble and/or water dispersible optional ingredients.

The level of liquid carrier in the compositions of the present invention is typically greater than about 80%, preferably greater than about 90%, more preferably greater than about 95%, by weight of the composition. When a concentrated composition is used, the level of liquid carrier is typically from about 2% to about 98%, by weight of the composition, preferably from about 35% to about 97%, more preferably from about 60% to about 95%, by weight of the composition.

Optionally, in addition to water, the carrier can contain a low molecular weight organic solvent that is highly soluble in water, e.g., ethanol, propanol, isopropanol, and the like, and mixtures thereof. Low molecular weight alcohols can help the treated fabric to dry faster. The optional solvent is also useful in the solubilization of some shape retention polymers described hereinbefore. The optional water soluble low molecular weight solvent can be used at a level of up to about 50%, typically from about 0.1% to about 25%, preferably from about 2% to about 15%, more preferably from about 5% to about 10%, by weight of the total composition. Factors that need to consider when a high level of solvent is used in the composition are odor, flammability, and environment impact.

When the curable silicone polymers is present in the composition, the liquid compositions can comprise a non-aqueous liquid carrier that do not promote crosslinking, such as low molecular weight monohydric alcohols, e.g., ethanol, methanol, isopropanol, and mixtures thereof. In this case, it is preferred to first prepare a concentrated composition containing the desired curable silicone in a suitable anhydrous solvent which is miscible with water, such as anhydrous low molecular weight alcohols, e.g., ethanol, methanol, isopropanol, and mixtures thereof, such concentrated composition is then diluted with water immediately prior to application to the target surface, and then let dry and cure on the surface.

II. Article of Manufacture

The present invention can also be comprise an article of manufacture comprising said composition in a container or in a spray dispenser. Preferably, the articles of manufacture are in association with a set of instructions for how to use the composition to treat fabrics correctly so as to provide good color, especially one step color restoration, including, e.g., the manner and/or amount of composition to apply or spray, and the preferred ways of handling of the fabrics, as will be described with more detailed herein below where wrinkle control is also desired. It is important that the instructions be as simple and clear as possible, such that using pictures and/or icons may be desirable.

Spray Dispenser

The article of manufacture herein can comprise a spray dispenser. The fabric color care composition is placed into a spray dispenser in order to be distributed onto the fabric. Said spray dispenser for producing a spray of liquid droplets can be any of the manually activated means as is known in the art, e.g. trigger-type, pump-type, non-aerosol self-pressurized, and aerosol-type spray means, for adding the fabric color care composition to small fabric surface areas and/or a small number of garments, as well as non-manually operated, powered sprayers for conveniently adding the fabric color care composition to large fabric surface areas and/or a large number of garments. Suitable manually activated sprayers and non-manually activated sprayers for use with the compositions of the current invention are described, e.g., in U.S. Pat. No. 5,783,544 issued Jul. 21, 1998 and U.S. Pat. No. 5,997,759 issued Dec. 7, 1999 to Trinh et al., both of said patents are incorporated herein by reference.

III. Method of Use

The fabric color care composition, which contains a fabric color care active, and optionally, e.g., perfume, odor control agent including cyclodextrin, antimicrobial actives and/or preservative, surfactant, antioxidant, metal chelating agent including aminocarboxylate chelating agent, antistatic agent, insect and moth repelling agent, fabric softener active, dye transfer inhibiting agent, brightener, soil release agent, dispersant, suds suppressor, and mixtures thereof, can be used by distributing, e.g., by placing, an effective amount of the aqueous solution onto the fabric surface or fabric article to be treated. Distribution can be achieved by using a spray device, a roller, a pad, by dipping, soaking, treating in the rinse water, etc.

An effective amount of the liquid composition of the present invention can be sprayed onto fabric and/or fabric articles. When the composition is sprayed onto fabric, an effective amount should be deposited onto the fabric, with the fabric becoming damp or totally saturated with the composition, typically from about 5% to about 150%, preferably from about 10% to about 100%, more preferably from about 20% to about 75%, by weight of the fabric. The treated fabric typically has from about 0.005% to about 4%, preferably from about 0.01% to about 2%, more preferably from about 0.05% to about 1%, by weight of the fabric of said fabric color care active. Once the fabric has been sprayed, it is hung until dry. It is preferable that the treatment is performed in accordance with the instructions for use, to ensure that the consumer knows what benefits can be achieved, and how best to obtain these benefits.

The compositions of the present invention can provide the fabric care benefits many types of fabrics such as those made with fibers selected from the group consisting of natural fibers, synthetic fibers, and mixtures thereof. Nonlimiting examples of natural fibers include cellulosic fibers, e.g., cotton, rayon, linen, poly/cotton blends, Tencel, and mixtures thereof; proteinaceous fibers, e.g., silk, wool, related mammalian fibers, and mixtures thereof; long vegetable fibers, e.g., jute, flax, ramie, coir, kapok, sisal, henequen, abaca, hemp, sunn, and mixtures thereof; and mixtures thereof. Nonlimiting examples of synthetic fibers include polyester, acrylic, nylon, and mixtures thereof.

Since the treatment of the worm, faded fabric necessarily changes the intensity of the fabric color, it is essential that the treatment needs to be uniform, either by saturating the fabric surface with the fabric color care composition, or by uniformly spraying the fabric surface with small droplets of the composition, so that visually the color improvement appears uniform. In other words, preferably, the fabric color care composition is applied uniformly to the entire visible surface of the fabric. Thus, it is preferable that the treatment is performed in accordance with an instruction for use, to ensure that the fabric needs to be applied uniformly to achieve the optimal color restoration and/or rejuvenation benefit.

The fabric color care composition can also be applied to fabric via a dipping and/or soaking process followed by a drying step. The application can be done in consumer's home with the use of a commercial product. The method is especially suitable for use with composition comprising fabric substantive and/or reactive fabric color care actives to provide a benefit that lasts or endures after more than one washing cycle, to minimize the accidental deposition of the composition on unwanted surfaces. The present invention also comprises a method of using concentrated liquid or solid fabric color care compositions, which are diluted to form compositions with the usage concentrations, as given hereinabove, for use in the "usage conditions". Concentrated compositions comprise a higher level of fabric color care active, typically from about 1% to about 99%, preferably from about 2% to about 65%, more preferably from about 3% to about 25%, by weight of the concentrated fabric color care composition. Concentrated compositions are used in order to provide a less expensive product per use. The concentrated product is preferably diluted with about 50% to about 10,000%, more preferably from about 50% to about 8,000%, and even more preferably from about 50% to about 5,000%, by weight of the composition, of water. Concentrated compositions can also be sprayed directly onto wet fabric where the fabric care is diluted in situ. When sprayed directly onto wet fabric, the fabrics color care compositions of the present invention contain said fabric color care active at a level from about 0.01% to about 25%, preferably from about 0.1% to about 10%, more preferably from about 0.2% to about 5%, and even more preferably from about 0.3% to about 3% by weight of the composition.

The reactive/curable silicones useful in the present invention include materials with low reactivity. Therefore, after the application of the active on the fabrics, for best result, it is preferable to refrain from washing the treated fabrics immediately, and keep the treated fabric unwashed for a time duration, preferably at least about one week, for the silicones to cure.

In a still further process aspect of the invention, the composition can be sprayed onto fabrics in an enclosed chamber containing the fabric to be treated for the color restoration/rejuvenation benefit, and optionally to be de-wrinkled, thereby providing ease of operation. This method is especially suitable for use with composition comprising fabric substantive and/or reactive fabric color care actives to provide a benefit that lasts after more than one washing cycle, to minimize the accidental deposition of the composition on unwanted surfaces. Examples of an enclosed chamber include a closed flexible bag, such as a plastic bag which is similar to a garment bag, preferably with a flexible opening which can be zipped up, or a cabinet or similar apparatus, with a closable door attached. Any spraying mechanism can be used to apply the fabric color care composition to fabrics. A preferred distribution of the garment care composition is achieved by using a fog form. The mean particulate diameter size of the fabric color care composition fog is preferably from about 3 microns to about 50 microns, more preferably from about 5 microns to about 30 microns, and most preferably from about 10 microns to about 20 microns.

Another process aspect of the present invention is the method of using an aqueous, alcoholic, or solid, preferably powder, fabric color care composition for treating fabric in the rinse step, comprising an effective amount of said fabric color care active, and optionally, perfume, fabric softener active, chlorine scavenging agent, dye transfer inhibiting agent, chemical stabilizer including antioxidant, antimicrobial actives and/or preservative, chelating agent, aminocarboxylate chelating agent, brighteners, soil release agents or mixtures thereof. The rinse water should contain typically from about 0.0005% to about 1%, preferably from about 0.0008% to about 0.1%, more preferably from about 0.001% to about 0.02% of the fabric color care active.

The present invention also relates to a method for treating fabric in the drying step, comprising an effective amount of said fabric color care active, and optionally, perfume, fabric softener active, dye transfer inhibiting agents, dye fixing agent, chemical stabilizer including antioxidant, antimicrobial active and/or preservative, aminocarboxylate chelating agent, brightener, soil release agent, and mixtures thereof. A preferred method comprises the treatment of worn, faded fabrics with a fabric color care composition dispensed from a sprayer at the beginning and/or during the drying cycle. It is preferable that the treatment is performed in accordance with the instructions for use, to ensure that the consumer knows what benefits can be achieved, and how best to obtain these benefits.

All percentages, ratios, and parts herein, in the Specification, Examples, and Claims are by weight and are the normal approximations unless otherwise stated.

The following are examples of the instant composition. The following compositions are prepared by mixing and dissolving the ingredients into clear or translucent solutions.

EXAMPLE 1

| Ingredients | 1a Wt. % | 1b Wt. % | 1c Wt. % | 1d Wt. % |
|---|---|---|---|---|
| LaraCare ® C300[1] | 1 | — | — | — |
| Celquat L-200[2] | — | 1.2 | — | — |
| Celquat SC240C[3] | — | — | 1 | — |
| Aqua Pro ® II QW[4] | — | — | — | 1.2 |
| Perfume | 0.1 | 0.05 | 0.07 | 0.1 |
| Kathon CG | 3 ppm | 3 ppm | 3 ppm | 3 ppm |
| Deionized Water | Bal. | Bal. | Bal. | Bal. |

[1]Cationic arabinogalactan.
[2]Polymeric quaternary ammonium salt of hydroxyethylcellulose and diallyldimethyl ammonium chloride.
[3]Polymeric quaternary ammonium salt of hydroxyethylcellulose reacted with trimethyl ammonium substituted epoxide.
[4]Stearyldimonium hydroxypropyl hydrolyzed wheat protein.

EXAMPLE 2

| Ingredients | 2a Wt. % | 2b Wt. % | 2c Wt. % | 2d Wt. % |
|---|---|---|---|---|
| LaraCare ® C300[1] | 5 | — | — | 5 |
| Celquat L-200[2] | — | 10 | — | — |
| Celquat SC240C[3] | — | — | 10 | — |

-continued

| Ingredients | 2a Wt. % | 2b Wt. % | 2c Wt. % | 2d Wt. % |
|---|---|---|---|---|
| Aqua Pro ® II QW[4] | — | — | — | 5 |
| Perfume | 0.5 | 0.8 | 0.5 | 0.3 |
| Polysorbate 60 | 1 | 1.6 | 1 | 1 |
| Kathon CG | 5 ppm | 5 ppm | 10 ppm | 5 ppm |
| Deionized Water | Bal. | Bal. | Bal. | Bal. |

Concentrated compositions of Examples 2 are diluted with water to obtain usage compositions for, e.g., spraying, soaking, dipping, worn, faded color fabrics.

EXAMPLE 3

| Ingredients | 3a Wt. % | 3b Wt. % | 3c Wt. % | 3d Wt. % |
|---|---|---|---|---|
| Silicone of Example XIV | 1.2 | — | 4 | — |
| Silicone of Example XVa | — | 1 | — | 5 |
| Perfume | 0.05 | 0.07 | 0.2 | 0.4 |
| Polysorbate 60 | — | — | 2 | 3 |
| Kathon CG | 3 ppm | 3 ppm | 5 ppm | 5 ppm |
| Deionized Water | Bal. | Bal. | Bal. | Bal. |

EXAMPLE 4

| Ingredients | 4a Wt. % | 4b Wt. % | 4c Wt. % | 4d Wt. % | 4e Wt. % |
|---|---|---|---|---|---|
| Silicone of Example IIIb | 1.5 | — | — | — | — |
| Silicone of Example V | — | 1 | — | — | — |
| Silicone of Example VId | — | — | 1.5 | — | — |
| Silicone of Example VIIb | — | — | — | 1 | — |
| Silicone of Example VIId | — | — | — | — | 2 |
| Perfume | 0.06 | 0.1 | 0.05 | 0.05 | 0.06 |
| Sorbitan monolaurate | 0.5 | — | 0.5 | 0— | 2 |
| Hexadecyltrimethyl ammonium chloride | — | — | 0.1 | | 0.2 |
| Kathon CG | 3 ppm | 3 ppm | 3 ppm | 3 ppm | 3 ppm |
| Deionized Water | Bal. | Bal. | Bal. | Bal. | Bal. |

EAMPLE 5

| Ingredients | 5a Wt. % | 5b Wt. % | 5c Wt. % | 5d Wt. % | 5e Wt. % |
|---|---|---|---|---|---|
| Silicone of Example IIIa | 25 | — | — | — | — |
| Silicone of Example VIe | — | 25 | — | — | — |
| Silicone of Example XIIb | — | — | 20 | — | — |
| Silicone of Example Xb | — | — | — | 10 | — |
| Silicone of Example XIIa | — | — | — | — | 40 |
| Perfume | 1 | 1.2 | 0.8 | — | 1.5 |
| Ethyl Alcohol | 74 | 73.8 | — | 75 | 50 |
| Isopropyl Alcohol | 0.5 | — | 79.8 | 15 | 8.5 |

Concentrated compositions of Examples 5 are diluted with water to obtain usage compositions for, e.g., spraying, soaking, dipping, worn, faded color fabrics.

EXAMPLE 6

| Ingredients | VI Wt % |
|---|---|
| GE 176-12669 Silicone Emulsion[1] | 1.43 |
| GE SM 2658 Silicone Emulsion[2] | 1.43 |
| Polyvinyl alcohol[3] | 0.065 |
| Glycerin | 0.01 |
| Kathon CG | 3 ppm |
| Perfume | 0.1 |
| Distilled water | Bal. |

[1]Cationic emulsion of curable hydroxy silicone, about 35% active.
[2]Cationic emulsion of curable aminofunctional silicone, about 35% active.
[3]Weight average molecular weight range from about 18,000 to about 27,000.

The compositions of Examples 1 to 6 (diluted when appropriate) are sprayed onto worn, faded color clothing using, e.g., the TS-800 sprayer from Calmar, and allowed to evaporate off of the clothing.

The compositions of Examples 1 to 6 (diluted when appropriate) are sprayed onto worn, faded color clothing, using a blue inserted Guala® trigger sprayer, available from Berry Plastics Corp. and a cylindrical Euromist II® pump sprayer available from Seaquest Dispensing, respectively, and allowed to evaporate off of the clothing.

The compositions of Examples 1 to 6 (diluted when appropriate) contained in rechargeable battery-operated Solo Spraystar sprayers are sprayed onto large worn, faded color fabric surfaces of fabric, i.e., several pieces of clothing, and allowed to evaporate off of these surfaces. The level of coverage is uniform and the ease and convenience of application is superior to conventional manually operated trigger sprayers.

The compositions of Examples 1 to 6 (diluted when appropriate) are used for soaking or dipping of worm, faded color fabrics which are then optionally wrung or squeezed to remove excess liquid and subsequently dried.

What is claimed is:

1. A method for restoring and/or rejuvenating color of a worn, faded color fabric, wherein the color benefit can be detected after the treated fabric is washed one time, and wherein said method comprises applying an effective amount of an aqueous fabric color care composition comprising a fabric color care active to said fabric using a spray dispenser, wherein said fabric color care active is selected from the group consisting of:

(A) water soluble and/or water dispersible cationic polymer, substituted materials thereof, derivatised materials thereof, and mixtures thereof;

(B) water dispersible reactive silicone, and mixtures thereof; and (C) mixtures thereof;

and wherein the color restoration and/or rejuvenation is characterized by the ability of said active to change the properties of a worn, faded black cotton (chino) twill test fabric, said changes in properties comprising:

(a) a percentage reflectance reduction $\Delta R$ of at least about 3%; and (b) a percentage pill number reduction $\Delta P$ of at least about 10%.

2. The method of claim 1 wherein the percentage reflectance reduction $\Delta R$ is at least about 8%, and the percentage pill number reduction $\Delta P$ is at least about 40%.

3. The method of claim 1, wherein said fabric color care composition is essentially free of any material that would cause the treated fabric to feel sticky to the touch.

4. The method of claim 1 wherein said fabric color care active is present at a level of from about 0.05% to about 10%, by weight of said fabric care composition.

5. The method of claim 4 wherein said fabric color care active is present at a level of from about 0.3% to about 2%, by weight of said fabric care composition.

6. The method of claim 1 wherein said spray dispenser comprises a trigger spray device.

7. The method of claim 1 wherein said spray dispenser comprises a non-manually operated sprayer selected from the group consisting of: power sprayer; air aspirated sprayer; liquid aspirated sprayer; electrostatic sprayer; and nebulizer sprayer.

8. The method of claim 1 wherein said composition is applied uniformly to the entire visible surface of the fabric.

9. The method of claim 1 wherein said fabric is wet, and wherein said fabric color care composition contains said fabric color care active at a level of from about 0.01% to about 25%, by weight of the composition.

10. The method of claim 9 wherein said fabric is wet, and wherein said fabric color care composition contains said fabric color care active at a level of from about 0.2% to about 5%, by weight of the composition.

11. The method of claim 1 wherein said fabric color care active is water soluble and/or water dispersible cationic polymers derived from natural sources, selected from the group consisting of polysaccharides; proteins; glycoproteins; glycolipids; substituted versions thereof; derivatised versions thereof; and mixtures thereof.

12. The method of claim 11 wherein said polysaccharide is selected from the group consisting of arabinogalactan; substituted versions thereof; derivatised versions thereof; and mixtures thereof.

13. The method of claim 1 wherein said cationic polymer comprises cationic monomers.

14. The method of claim 1 wherein said water dispersible reactive silicone is an aminofunctional silicone conforming to the following general structure:

$$(R^1)_aR_{3-a}Si—(—O—SiR_2)_m—(—O—SiRB)_p—(—O—SiRD)_q—[OSiR_2—J—(G)_g—(J)_j—(E)_k—J—SiR_2]_r—O—Si(R^1)_bR_3$$

wherein:

each R group is the same or different and is an alkyl, aryl, or mixtures thereof;

each cationic B group is an —X—E group with each X being selected from the group consisting of $—CH_2CH_2CH_2—$, $—CH_2CH(CH_3)CH_2—$, $—CH_2CH_2—$, $—CH_2CH(OH)CH_2OCH_2CH_2CH_2—$, and $—CH_2$-phenylene-$CH_2CH_2$—, and mixtures thereof; and each E being selected from the group consisting of amino group and quaternary ammonium derivatives thereof; cyclic amino group and quaternary ammonium derivatives thereof; imidazole group and imidazolium derivatives thereof; imidazoline group and imidazolinium derivatives thereof; polycationic group, and mixtures thereof;

each optional D group is a poly(ethyleneoxy/propyleneoxy) group having the general structure:

$$—Z—O(C_2H_4O)_c(C_3H_6O)_dR^3$$

wherein each Z is selected from the group consisting of hydrocarbon or oxygenated hydrocarbon linking group, comprising $—CH_2CH_2CH_2—$, $—CH_2CH_2—$, $—CH_2CH(OH)CH_2OCH_2CH_2CH_2—$, -phenylene-$CH_2CH_2$— and $—CH_2$-phenylene-$CH_2CH_2$—; amino-hydrocarbon linking group; and mixtures thereof; each $R^3$ group is the same or different and is selected from the group consisting of hydrogen, R, cationic nitrogen functional E group, $—CH_2CH(R)OH$, $—CH_2C(R)_2OH$, $—CH_2CH(OH)CH_2OR$, $—CH_2CH(OH)CH_2(OCH_2CH_2)_cOR$; tetrahydropyranyl, —CH(R)OR, C(O)H, and —C(O)R group; each c is at least about 2, with total c (for all polyalkyleneoxy side groups) having a value of from about 4 to about 2500; total d is from 0 to about 1000; total c+d has a value of from about 4 to about 2500; and each e is from 1 to about 20;

each optional G is $—O(C_2H_4O)_v(C_3H_6O)_w—$; each J is selected from X and $—CH_2CH(OH)CH_2—$; each optional E is a cationic group defined as hereinabove; each v is from 0 to about 200; each w is from 0 to about 50; each g and k is from 0 to about 10; j is g+k−1, within the segment designated as $(G)_g—(J)_j—(E)_k$, the units can be arranged in any order, providing that no O—O bonds and/or N—N are formed;

each $R^1$ group is the same or different and is selected from the group consisting of R, B, and D group;

each a and/or b is an integer from 0 to 3;

m is from about 5 to about 1600;

a, and b, p, and the $R^1$ groups of the terminal groups $(R^1)_aR_{3-a}Si—O—$ and $—O—Si(R^1)_bR_{3-b}$ are selected such that the silicone polymer comprises at least one cationic group in the form of an Si—B group; with a p to (m+p) ratio of from 0 to about 1:2; and a, and b, q, and the $R^1$ groups of the terminal groups $(R^1)_aR_{3-a}Si—O—$ and $O—Si(R^1)_bR_{3-b}$ are selected such that the silicone polymer optionally comprises at least one poly(ethylenoxy/propyleneoxy) Si—D group; and at least about two Si—D groups; with typically the q to (m+p+q) ratio ranges from about 1:1000 to about 1:3; r is from 0 to about 100, with r being 0 when neither a polyalkyleneoxy group nor a cationic group is part of the polymer backbone; and when one or more polyalkyleneoxy groups and/or cationic groups are part of the polymer backbone, the r to (m+p) ratio ranges typically from about 1:1000 to about 1:2;

wherein said silicone polymer can be linear, branched, and/or cyclic; and wherein different $—O—SiR_2—$, ——O—SiRB—, —O—SiRD—, and $—[OSiR_2—J—(G)_g—(J)_j—(E)_k—J—SiR_2]—$ groups can be distributed randomly in the silicone backbone and/or organized as block copolymers of different degrees.

15. The method of claim 14 wherein in each R group is methyl; $R^3$ group is a methyl and/or ethyl group; and wherein said silicone polymer is linear.

16. The method of claim 1 wherein said reactive silicone conforms to the following general structure:

$$(R^1)_aR_{3-a}Si—(—O—SiR_2)_m—(—O—SiRA)_n—(—O—SiRB)_p—(—O—SiRD)_q—[OSiR_2—J—(G)_g—(J)_j—(E)_k—J—SiR_2]_r—O—Si(R^1)_bR_{3-b}$$

wherein:

each R group is the same or different and is an alkyl, aryl, or mixtures thereof;

each A group is the same or different and is selected from the group consisting of hydrogen, —OH, —OR, $—OCOCH_3$, $—CH_2CH_2Si(OR)_3$, $—CH_2CH_2Si(OR)_2R$, $—CH_2CH_2Si(OR)R_2$, and mixtures thereof;

each optional cationic B group is an —X—E group with each X being a hydrocarbon or oxygenated hydrocarbon linking group selected from the group consisting of —$CH_2CH_2CH_2$—, —$CH_2CH(CH_3)CH_2$—, —$CH_2CH_2$—, —$CH_2CH(OH)CH_2OCH_2CH_2CH_2$—, and —$CH_2$-phenylene-$CH_2CH_2$—, and mixtures thereof; and each E being a cationic nitrogen functional group selected from the group consisting of amino group and quaternary ammonium derivatives thereof; cyclic amino group and quaternary ammonium derivatives thereof; imidazole group and imidazolium derivatives thereof; imidazoline group and imidazolinium derivatives thereof; polycationic group; and mixtures thereof;

each optional D group is a poly(ethyleneoxy/propyleneoxy) group having the general structure:

$$—Z—O(C_2H_4O)_c(C_3H_6O)_dR^3$$

wherein each Z is a linking group; selected from the group consisting of hydrocarbon or oxygenated hydrocarbon linking group comprising —$CH_2CH_2CH_2$—, —$CH_2CH(CH_3)CH_2$—, —$CH_2CH_2$—, —$CH_2CH(OH)CH_2OCH_2CH_2CH_2$—, -phenylene-$CH_2CH_2$— and —$CH_2$-phenylene-$CH_2CH_2$—; aminohydrocarbon linking group; and mixtures thereof; each $R^3$ group is the same or different and is selected from the group consisting of hydrogen, R, JE, —$CH_2CH(R)OH$, —$CH_2C(R)_2OH$, —$CH_2CH(OH)CH_2OR$, —$CH_2CH(OH)CH_2(OCH_2CH_2)_cOR$, tetrahydropyranyl, —CH(R)OR, C(O)H, and —C(O)R group; each c is at least 2, with total c (for all polyalkyleneoxy side groups) having a value of from about 4 to about 2500; total d is from 0 to about 1000; c is equal or larger than d; total c+d has a value of from about 4 to about 2500; and each e is from 1 to about 20;

each optional G is —$O(C_2H_4O)_v(C_3H_6O)_w$—; each J is selected from X and —$CH_2CH(OH)CH_2$—; each optional E is a cationic group defined as hereinabove; each v is from 0 to about 200; each w is from 0 to about 50; each and k is from 0 to about 10; j is g+k−1, providing that no O—O bonds are formed;

each $R^1$ group is the same or different and is selected from the group consisting of R, A, B, and/or D group;

each a and b is an integer from 0 to 3;

m is from about 5 to about 1600;

n, a, and b, and the $R^1$ groups of the terminal groups $(R^1)_aR_{3-a}Si$—O— and O—$Si(R^1)_bR_{3-b}$ are selected such that the silicone polymer comprises at least one reactive Si functional group in the form of an Si—A group selected from the group consisting of Si—H, Si—OH, Si—OR, Si—OCOR, and mixtures thereof; with a n to (m+n) ratio of from 0 to about 1:2 when p=0, and a n to (m+n+p) ratio of from 0 to about 1:2 when p is not 0;

p, a, and b, and the $R^1$ groups of the terminal groups $(R^1)_aR_{3-a}Si$—O— and O—$Si(R^1)_bR_{3-b}$ are selected such that the silicone polymer optionally comprises at least one cationic group in the form of an Si—B group; with a p to (m+n+p) ratio of from 0 to about 1:2; and q, a, and b, and the $R^1$ groups of the terminal groups $(R^1)_aR_{3-a}Si$—O— and O—$Si(R^1)_bR_{3-b}$ are selected such that the silicone polymer optionally comprises at least one poly(ethyleneoxy/propyleneoxy) Si—D group; with a q to (m+n+p) ratio of from about 1:000 to about 1:3;

r is from 0 to about 100, with r being 0 when neither a polyalkyleneoxy group nor a cationic group is part of the polymer backbone; and when one or more polyalkyleneoxy group and/or cationic groups are part of the polymer backbone, a r to (m+n+p) ratio of from about 1:1000 to about 1:2;

wherein said silicone polymer can be linear, branched, and/or cyclic; and wherein different —O—$SiR_3$—, —O—SiRA—, —O—SiRB—, —O—SiRD—, and —[$OSiR_2$—J—$(G)_g$—$(J)_j$—$(E)_k$—J—$SiR_2$]— groups can be distributed randomly in the silicone backbone and/or organized as block copolymers of different degrees.

17. The method of claim 16 wherein each R group is methyl; $R^3$ group is a methyl and/or ethyl group; and wherein said silicone polymer is linear.

18. The method of claim 16 wherein said reactive silicones comprises poly(alkyleneoxy) D groups selected from the group consisting of: pendant and/or terminal poly(ethyleneoxy) groups capped with a $C_1$–$C_4$ alkyl group, a hindered alcohol group, or a protected alcohol group; pendant uncapped poly(ethyleneoxy) groups comprising at least about 11 ethyleneoxy units; pendant poly(ethyleneoxy) groups capped with cationic E groups and comprising at least about 11 ethyleneoxy units; internal poly(ethyleneoxy) groups comprising at least about 11 ethyleneoxy units, and mixtures thereof.

19. The method of claim 1 wherein said fabric color care composition additionally comprises at least one of the following adjunct materials: perfume, odor control agent, surfactant, brightener, antimicrobial active and/or antibacterial preservative, chelating agent, enzyme, antioxidant, static control agent, suds suppressor, dye transfer inhibiting agent, soil release agent, dispersant, insect repelling agent, moth repelling agent, and/or liquid carrier.

20. An article of manufacture comprising a fabric color care composition in a package comprising a spray dispenser in association with a set of instruction for use comprising an instruction to apply at least an effective amount of said fabric color care active and/or said fabric color care composition, to provide the color restoration and/or rejuvenation benefit, and wherein said color benefit can be detected after the treated fabric is washed one time, said composition comprising:

(A) a fabric color care active selected from the group consisting of water soluble and/or water dispersible cationic polymer, substituted materials thereof, derivatised materials thereof, and mixtures thereof; water dispersible reactive silicone; and mixtures thereof; and mixtures thereof;

(B) optionally, an effective amount to provide olfactory effects of perfume;

(C) optionally, to reduce surface tension, and/or to improve performance and formulatability, an effective amount of surfactant;

(D) optionally, an effective amount to absorb malodor, of odor control agent;

(E) optionally, an effective amount, to kill, or reduce the growth of microbes, of antmicrobial active;

(F) optionally, an effective amount to provide improved antimicrobial action of aminocarboxylate chelator;

(G) optionally, an effective amount of antimicrobial preservative; and (H) optionally, an aqueous and/or alcoholic carrier;

wherein said composition being essentially free of any material that would cause the treated fabric to feel sticky to the touch; and wherein said set of instructions for use optionally comprises pictures and/or icons.

21. The article of manufacture of claim 20 wherein said fabric color care composition is an aqueous composition containing from about 0.1% to about 5%, by weight of said composition, of said fabric color care active.

22. The article of manufacture of claim 20 wherein said composition additionally comprises at least one of the following adjunct materials: perfume, odor control agent, surfactant, antimicrobial active and/or antibacterial preservative, metal chelating agent, enzyme, static control agent, fabric softening active, dye transfer inhibiting agent, soil release agent, brightener, antioxidant, suds suppressor, insect repelling agent, moth repelling agent, and/or liquid carrier.

23. The article of manufacture of claim 22 wherein said set of instructions for use further comprises an instruction to apply an amount of composition to provide from about 0.005% to about 4% of fabric color care active, by weight of the fabric.

24. The article of manufacture of claim 23 wherein said set of instructions for use further comprises an instruction to apply said composition uniformly to the entire visible surface of the fabric.

* * * * *